US007080936B1

(12) United States Patent
Simpson

(10) Patent No.: US 7,080,936 B1
(45) Date of Patent: Jul. 25, 2006

(54) WRAP SPRING CLUTCH SYRINGE RAM AND FRIT MIXER

(76) Inventor: Frank B. Simpson, 5941 Highway 113, Waunakee, WI (US) 53597

( * ) Notice: Subject to any disclaimer, the term of this patent is extended or adjusted under 35 U.S.C. 154(b) by 50 days.

(21) Appl. No.: 10/615,072

(22) Filed: Jul. 8, 2003

Related U.S. Application Data

(63) Continuation-in-part of application No. 09/880,602, filed on Jun. 13, 2001, now abandoned.

(51) Int. Cl.
*B01F 15/02* (2006.01)
*B65D 88/54* (2006.01)

(52) U.S. Cl. ..... 366/162.3; 366/268; 222/282

(58) Field of Classification Search ..... 366/162.3, 366/268; 604/416, 208, 128, 151, 152; 128/DIG. 1; 222/325–327, 390, 333, 282; 192/84.81
See application file for complete search history.

(56) References Cited

U.S. PATENT DOCUMENTS 3,156,236 A * 11/1964 Williamson ..... 128/DIG. 1
3,415,419 A * 12/1968 Jewett et al. ..... 128/DIG. 1
3,880,138 A * 4/1975 Wootten et al. ..... 128/DIG. 1
3,997,084 A * 12/1976 Davis, Jr. ..... 222/326
4,059,110 A * 11/1977 Wuthrich et al. ..... 128/DIG. 1
4,257,540 A * 3/1981 Wegmann et al. ..... 222/262
4,273,269 A * 6/1981 Davis, Jr. ..... 222/326
4,630,722 A * 12/1986 Figueira et al. ..... 192/84.81
5,020,693 A * 6/1991 Ernst et al. ..... 222/137
5,034,004 A * 7/1991 Crankshaw ..... 128/DIG. 1
5,090,538 A * 2/1992 Osawa ..... 192/84.81
5,176,646 A * 1/1993 Kuroda ..... 128/DIG. 1
5,244,461 A * 9/1993 Derlien ..... 128/DIG. 1
5,286,105 A * 2/1994 Herold et al. ..... 366/162.3
5,690,618 A * 11/1997 Smith et al. ..... 128/DIG. 1
6,056,716 A * 5/2000 D'Antonio et al. ..... 604/68
6,371,336 B1 * 4/2002 Keller ..... 192/48.2

OTHER PUBLICATIONS

Dexter Northrop and Frank Simpson, Kinetics of Enzymes With Isomechanisms: Britton Induced . . . Apr. 15, 1998, p. 290 & 2nd column.
H. Hartridge and F.J.W. Roughton, A Method of Measuring the Velocity of Very Rapid Chemical Reactions, 1923, p. 378-382.

(Continued)

*Primary Examiner*—Tony G. Soohoo
(74) *Attorney, Agent, or Firm*—Donald J. Ersler

(57) ABSTRACT

A wrap spring clutch syringe ram pushes at least one syringe with virtually instantaneous starting and stopping, and with constant motion at a defined velocity during the intervening push. The wrap spring clutch syringe ram includes an electric motor, a computer, a flywheel, a wrap spring clutch, a precision lead screw, a slide platform, and syringe reservoirs, a mixing chamber, and a reaction incubation tube. The electric motor drives a flywheel and the wrap spring clutch couples the precision lead screw to the flywheel when a computer enables a solenoid of the wrap spring clutch. The precision lead screw drives a precision slide which causes syringes to supply a portion of solution into the mixing chamber and the incubation tube. The wrap spring clutch syringe ram is designed to enable the quantitative study of solution phase chemical and biochemical reactions, particularly those reactions that occur on the subsecond time scale.

39 Claims, 30 Drawing Sheets

OTHER PUBLICATIONS

H. Gutfreund, Rapid Mixing: Continuous Flow, 1969, p. 236-239, Figures 3A & 3B.

R.C. Bray, Sudden Freezing as a Technique for the Study of Rapid Reactions, 1961 p. 190 col. 1, Through p 193. Figs 1, 2, 3.

David P. Ballou, Instrumentation for the Study of Rapid Biological Oxidation-Reduction Reactions by EPR and Optical Spectroscopy, 1971, pp. 2-7, 8, 13-14, 15, 19-20, 21-53, 214-216, 240.

Update Instruments, Web Page: http:///www.updateinstrument.com/rapid__mixing-equipment.htm, p. 1 of 1.

Harvard Apparatus, Inc., Web Page: http;//www.harvardapparatus.com/pdffiles/b2k__a⊖14.pdf, p. A14.

Bio-Logic-Scientific Instruments SA, Web Page: http://www.bio-logic. fr/rapid-kinetics/qfm20.html , pp. 1, 2, 3.

Warner / PSI/ Danahar, Web Pages: http://www.danahermcg.com/prod/brakes,asp, p. 1 http://www.danahermcg.com/prod/linear,asp . p. 1 http://www.globallinear.com/main.htm, p. 1 http://www.globallinear.com/prod.htm, p. 1.

OLIS Inc., Website: http://www.olisweb.com.

Kintek Coropration, Web Pages: http://www.kintek-corp.com , pp. 1-2 http://www.kintek-corp.com/rqf3.htm, pp. 1, 2, 3, 4 of 6 pages http://www.kintek-corp.com/sf-2001.htm pp. 1, 2, 3, 4 of 6 pages.

Hi-Tech Scientific, Web Pages: http://www.hi-techsci.co.uk, p. 1 http://www.hi-techsci.co.uk/scientific/noframes/homepage.html, p. 1 of 2 pages http://www.hi-techsci.co.uk/scientific/noframes/products.html, pp. 1 & 2. http://www.hi-techsci.co.uk/scientific/noframes/rqf63.html, pp. 1 & 2. http://www.hi-techsci.co.uk/scientific/noframes/sf61dx2.html, pp. 1 & 2 of 3 pages.

* cited by examiner

Conditions:

1) Continuous laminar flow of carrier stream, Reynolds number (Re) = 821.
2) 0.025 second pulse injection of dye, centered at time zero.
3) Dye is bromophenol blue + $HCO_3^-$ in water.
4) Reaction delay lines are 0.020" (0.5 mm) i.d., and of variable lengths.

Fig. 13

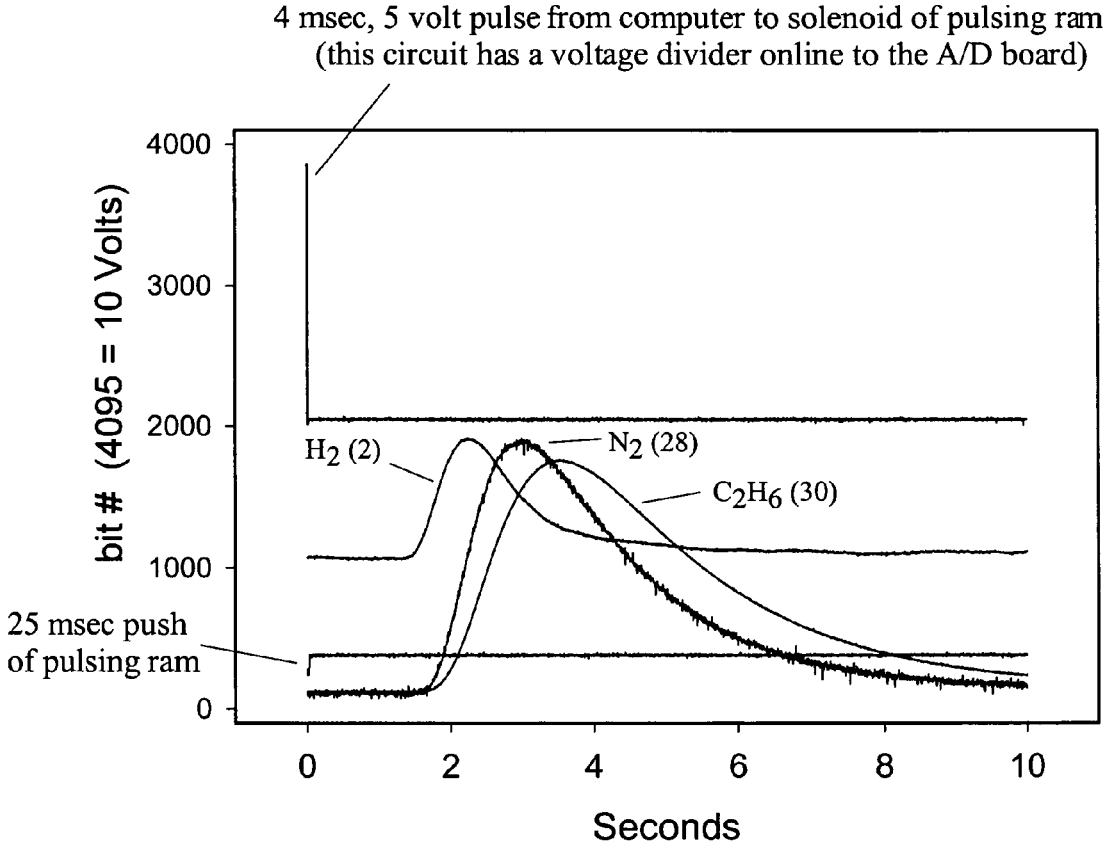

Conditions:

Enzyme syringe: $H_2O$ equilibrated (vol/vol) with 93% $N_2$, 5% $H_2$, 2% $C_2H_6$.
Total pressure = 3.7 atm.
Substrate syringe: Omitted.
Carrier: Argon-sparged $H_2O$. (No check valve in system.)
Reaction delay line: 2 meters long, 1.7 sec long, 0.022 inch i.d., 1/16 inch o.d., nylon.

Monitoring Five Channels Concurrently:

1) Mass 2 ($H_2$) at 5 msec intervals.
2) Mass 28 ($N_2$) at 5 msec intervals.
3) Mass 30 ($C_2H_6$) at 5 msec intervals.
4) Computer output pulse to relay of ram at 1 msec intervals.
5) Ram displacement (output of linear potentiometer) at 1 msec intervals.

● $CO_2$ monitored by push-pause-push membrane inlet mass spectrometry.

—— $H^+$ by stopped-flow spectrophotometry. Monitoring brom cresol purple at 600 nm.

WRAP SPRING CLUTCH SYRINGE RAM AND FRIT MIXER

CROSS-REFERENCES TO RELATED APPLICATIONS

This is a continuation-in-part patent application taking priority from patent application Ser. No. 09/880,602, filed on Jun. 13, 2001 now ABN.

UNITED STATES GOVERNMENT RELATED INVENTION

This invention was made with U.S. Government support under Contract No. DE-FG02-87ER13707, awarded by the United States Department of Energy. The U.S. Government has certain rights in this invention.

BACKGROUND OF THE INVENTION

1. Field of the Invention

The present invention relates generally to mixing solutions and more specifically to a wrap spring clutch syringe ram which mixes precise amounts of solutions.

2. Discussion of Prior Art

There are two existing clutched rapid-reaction syringe rams. However, neither is commercially available. The first device is described by H. Gutfreund (Methods in Enzymology XVI, 1969, pp 229–249, ed. Kenneth Kustin, Academic Press, New York). Gutfreund used a 700 rpm motor coupled to a firmly engaging magnetic clutch and a magnetic brake. The microswitches which controlled the clutch and the brake were operated by a lever which moved with the syringe barrier.

A second device was reported in the doctoral thesis of David P. Ballou, 1971, Biochemistry, University of Michigan. His device employed a silicone-controlled-rectifier (SRC) controlled DC motor which turned a Volkswagen flywheel. The flywheel engaged a gearbox, which drove a flat, spiral-shaped, snail-shell-like cam, the slope of which pushed a cam follower, which pushed the syringes until the maximum diameter of the cam was reached. The output of the gearbox was a rotating table, and the cam was a separate disk which laid flat and motionless on top of the rotating table, mounted on a central shaft and bearing. Although it is not clear from his thesis, it appears that the cam could be engaged positively to the rotating table to initiate a push, by a pin that operated as a clutch. Apparently the clutch pin was pressed manually through a hole in the cam, so that the clutch pin extended through the cam and into a matching hole drilled into the rotating table.

A single-stop, or a multiple-stop, wrap spring clutch could be incorporated between the gearbox and the cam, or between the flywheel and the gearbox, of Professor Ballou's design, to enable multiple pushes. This cam design of wrap spring clutch syringe ram is discussed below, with reference to FIGS. 15 and 16.

A non-clutched rapid-reaction syringe ram manufactured by Update Instruments (United States) is referred to in the Summary of Invention section. The Update Instruments design utilizes a low inertial DC motor coupled to an optical encoder. Manufacturers of non-clutched rapid-reaction syringe rams that utilize stepper motors include Bio-Logic (France), Hi-Tech (England), and KinTek (United States).

The original rapid-reaction device of Hartridge and Roughton of 1923, placed each reactant into a separate pressurized vessel, and drained the two solutions simultaneously from their respective vessels down separate lines that joined together at a "Y". The reaction commenced at the "Y" junction, where the two solutions met and mixed, and the period of reaction was determined by the rate of flow of the mixed solution down the exit tube of the "Y", and by the volume of the exit tube, or delay line. The detector was placed at various points along the delay line, to monitor the extent of reaction verses period of flow after mixing.

An early version of a rapid-reaction ram was constructed by R. C. Bray in 1961. The syringe ram was driven by a piston, which was driven by hydraulic fluid. Pressurized gas was applied over the hydraulic fluid, which was contained in a reservoir. The hydraulic fluid was dispensed to the piston which drove the syringe ram, by means of an adjustable valve to determine rate of flow, and by an electrically-triggered, on-off valve, which immediately started and stopped the flow of hydraulic fluid, and thus the advancement of the ram. With the on-off valve open, the speed of the syringe ram was determined by the pressure over the fluid, by the degree of opening or closure of the adjustable valve, by the surface area of the top of the piston, by the friction of the ram, and by the back pressure of the syringes.

Several companies, such as OLIS Incorporated, manufacture stopped-flow devices, that are used to push syringes and to mix solutions rapidly for study of chemical and biochemical reactions. Stopped-flow devices usually employ a pressurized-gas-driven piston to push the syringes. Solutions are ejected rapidly from the syringes, through a mixing chamber, thence into an observation cell, and rapidly into an opposing syringe. When the opposing syringe is filled to a predetermined volume, flow immediately stops, and the syringe plunger of the filled stopping syringe trips a switch which initiates data collection. These pressurized-gas-driven, stopped-flow syringe rams may be considered to be simplified versions of the more precise, motor-driven, rapid-reaction syringe rams already mentioned.

Harvard Instruments, of Massachusetts, manufactures syringe pumps that usually are used for slow infusion. These pumps may employ synchronous electric motors and gear boxes, or programmable stepper motors, to push syringes at a defined rate. Other companies manufacture similar units.

Warner Electric manufactures programmable linear actuators that couple any one of several types of electric motors to a screw drive for precise linear motion and positioning. These actuators are comparable to the present invention, however they do not employ a flywheel, or a wrap spring clutch. Their systems appear to be designed for use in automated manufacturing, rather than for the purpose of pushing syringes per our application. The wrap spring clutch used in our system was manufactured by Warner Electric. There are many manufacturers of linear actuators, and of wrap spring clutches.

It also is possible that the present invention may have applications other than just pushing syringes.

SUMMARY OF THE INVENTION

There is a need among biochemists and chemists for a syringe pushing device that is able to start and to stop instantly, and to move at a constant, defined velocity during its push. To achieve a precise time base for study of rates of chemical and biochemical reactions in solution, especially rates of fast reactions, it is necessary to initiate and to terminate reactions quickly, reproducibly, and with high precision. The need is for a device which is able to push two or more syringes reliably, precisely, and reproducibly to enable quantitative kinetic study of rapid chemical and biochemical reactions.

At the present time, there are two systems which attempt to accomplish this purpose. One system, utilizes a variable-speed, low-inertial, DC motor coupled to an optical encoder. The motor turns a lead screw at a controlled velocity, and the lead screw drives a threaded nut to which is mounted a pushing block. The motor is initially at rest, and when activated, it accelerates to a preselected rotational velocity, which in turn causes the lead screw to accelerate to a specified rotational velocity, which in turn causes the threaded nut/push block assembly to accelerate to a preselected linear velocity, which in turn pushes the syringe(s) After a specified period of time, or a specified distance of travel of the push block at a constant velocity, rotation of the DC motor is stopped, and the system decelerates to rest.

The difficulty with this first system is that the motor, lead screw, and push block have inertia. All are initially at rest, and after a push must return to rest; thus time is needed for the motor, etc., to accelerate from rest to the desired velocity, and to decelerate back to zero velocity, at the beginning and end of each push. When this DC motor design is coupled to a feedback system with an optical encoder, or even to a computer-enhanced, feed-forward system, the time needed to accelerate and to decelerate even a low-inertial DC motor and drive system can be appreciable, and unacceptably long. For example, with such a commercially available unit (manufactured by Update Instruments of Madison, Wis.), pushes of less than a few tenths of a second duration are not practical because it is not possible to accelerate to the desired constant push velocity, before deceleration must be initiated.

A second type of system utilizes a screw drive driven by a stepper motor. Stepper motors are very effective for nearly instantaneous starting and stopping, provided that the inertia of the motor and the mass of the load are small. The dilemma is that as the power of the stepper motor increases, the size of the motor, and thus the rotational inertia of the motor, also increase. Thus when one demands a stepper motor to accelerate too rapidly, or to push too large a load, the motor stalls, skipping steps. To prevent this slippage, most electronic driving systems for stepper motors ramp the acceleration, thus accelerating the motor and drive system to its final velocity in stages, and at a rate which does not exceed the inertial limits of the motor. In other words, effectively instantaneous acceleration of stepper motors is possible, but only within a boundary of inertial limits. We have employed a commercially available stepper motor design (manufactured by the French company, Bio-Logic) to drive syringes, and have found that in addition to slippage during acceleration, the stepper motor also skips steps at the higher back pressures of the syringes and narrow-bore delay lines, during the so-called, constant-velocity portion of the push cycle. Slippage of stepper motor designs leads to uncertainties in the duration, distance, and velocity of a push. Attachment of a servo mechanism to a stepper motor, perhaps as an encoder system, would allow monitoring and feedback adjustment of the rotational position and velocity of the stepper motor.

The present invention circumvents most of the difficulties inherent to the aforementioned DC motor and stepper motor designs, by employing a motor and flywheel that already are rotating at the desired final velocity needed for the push. Though the lead screw, push block, and syringes are initially at rest, their combined inertia is negligible, and is about $1/2800$th that of our spinning aluminum flywheel. The wrap-spring clutch system engages fully, and accelerates the load from rest to full velocity, reproducibly within 3 msec, and this clutch disengages and decelerates the rotating lead screw back to rest within 1.5 msec. Between start and stop, the motion of the push block is of constant velocity and of repeatable duration. The problems of stalling and inadequate power exhibited by the stepper motor designs are eliminated by the use of a suitably large flywheel and motor. Ramped acceleration is not necessary with the present invention, because acceleration occurs within 3 msec, regardless of the load, and the period of acceleration is independent of the rotational velocity of the motor and flywheel. The present invention additionally has very high torque, and is able to push against very high back pressures, which normally would cause a stepper motor to stall.

The previously mentioned DC-motor, stepper-motor and servo-motor designs have the advantage that subsequent pushes can be of any desired velocity. The wrap-spring clutch system can be programmed easily for different durations and distances of push, and for any number, combination, and frequency of successive pushes; however different velocities of push necessitate varying the speed of the motor and flywheel, which is not necessarily a rapid process due to the inertia of the flywheel.

The present flywheel and wrap-spring clutch system preferably employs a dual pulley/v-belt drive, and an acme lead screw with a constant pitch of 4 turns per centimeter. Electric motors rated at ¼ and ⅓ horsepower have been found satisfactory. The velocity of a push also can be varied by changing the ratio of the pulleys (or were a gearbox employed, the gear ratio) linking the flywheel and motor, or by changing the pitch of the lead screw drive.

A problem inherent to the wrap spring clutch, is that rotation is permitted in only one direction. The present unidirectional clutch was selected to rotate in a counterclockwise direction (as the ram is viewed from the rear), because the system employs a right-hand threaded lead screw. Rotation of this lead screw in a counterclockwise direction upon engagement of the clutch, causes the push block and the syringes to move in a forward direction. However, because it is not possible to rotate this clutch in a clockwise direction (except by breaking the clutch), to return the push block back to its original starting position, it first is necessary to somehow disengage the lead screw or the push block from the irreversible clutch. To enable reversal of the clutch-driven system, a manually removable locking pin is used which couples and decouples the push block from the threaded nut that rides along the lead screw. The position of the push block then can be reversed simply and quickly, by manually removing the locking pin, and by manually rotating the threaded nut backwards along the lead screw. Obviously the clutch must not be engaged during the reversal process; however with the clutch disengaged, the push block can be reversed safely with the motor and flywheel running at full speed. An automatic method of reversal could also be used.

Though the unidirectionality and irreversibility inherent to the wrap spring clutch can be viewed as disadvantageous, irreversibility actually fulfills a critical role between pushes of the ram. Because of its irreversibility, the wrap spring clutch can maintain the rotational position of the stopped lead screw, and thus can hold the ram's stopped push block stationary between pushes, even against a back pressure or a load. In fact, because of the combination of both engagement and brake springs in the design of the Warner wrap spring clutch, the lead screw cannot be rotated either in a forward, or in a reverse, direction when the wrap spring clutch is disengaged. Thus both before and after a push of the wrap spring clutch syringe ram, the push block and the syringe(s) remain held firmly in their beginning and final positions because rotation of the lead screw is prevented by the immobilized output hub of the disengaged wrap spring clutch. Thus the single wrap spring clutch serves the functions of starting the load very rapidly, of moving the load precisely, of stopping the load very rapidly and precisely, and of holding the load stationary before and after each push. To fulfill these design requirements normally would necessitate, at minimum, a separate clutch and a separate brake, plus some means to control and to coordinate their actions precisely and reproducibly; these requirements all are fulfilled completely, reproducibly, and efficiently, by the wrap spring clutch syringe ram.

The wrap spring clutch is the heart of the present invention, and its use in the field of rapid-reaction kinetics is new. The wrap spring clutch consists of three elements: an input hub, an output hub, and a spring whose inside diameter is just slightly smaller than the outside diameter of the two hubs. When the spring is forced over the two hubs, rotation in the direction of the arrow wraps it down tightly on the hubs, positively engaging them. The greater the force of rotation, the more tightly the spring grips the hubs. The wrap spring clutch/brake utilizes two control tangs to hold either the clutch or brake spring open. The two springs are wrapped in opposite directions. When the clutch and brake control tangs rotate with the hub input, the hub input and shaft output are positively engaged by the clutch spring. When the brake control tang is locked by the stop collar, the brake spring wraps down to engage the shaft output to the stationary brake hub. At the same time, the clutch spring unwraps slightly, allowing the hub input to rotate freely.

The unidirectional output hub of the wrap spring clutch rotates with, and in the same direction as, the unidirectional input hub whenever the clutch is engaged; however, springs within the wrap spring clutch firmly prevent the output hub from rotating in either direction when the clutch is disengaged. This latter feature enables the wrap spring clutch to maintain a load stationary, even against an external force, whenever the clutch is disengaged. The engagement time of their wrap spring clutches is said by Warner Electric to be within 3 msec, to bring a stationary shaft from rest to full rotational velocity, and within 1.5 msec to decelerate a rotating shaft from full rotational velocity to rest. The CB-2 can be used at a maximal rotational velocity of 1800 rpm, and we routinely use ours at 1200 rpm. The maintenance-free bearings of these clutches are composed of sintered metal impregnated with lubricating oil; apparently if these clutches rotate in excess of the recommended maximal velocity, the lubricating oil is removed from the bearings by centrifugal force. The wrap spring clutch employs a 24 volt DC solenoid. The 24 DC solenoid is supplied with 44.2 volts DC from a power supply.

The fluid output of each syringe is fed through a separate line to a mixing chamber, where the flowing fluids expelled from two or more syringes meet and mix. Mixing chambers can be of various designs. We here present a mixer that employs a porous frit immediately beyond the point of union of the flowing streams. The frit assists to mix the flowing reagent solutions rapidly, and in minimal volume, and thus enables rapid initiation of reactions.

BRIEF DESCRIPTION OF THE DRAWINGS

FIG. 13 is a graph of the responses of a membrane inlet MAT 250 mass spectrometer to an injection pulse of water equilibrated with $H_2$ (mass 2), $N_2$ (mass 28), and $C_2H_6$ (mass 30) of a wrap spring clutch syringe ram in accordance with the present invention.

DETAILED DESCRIPTION OF THE PREFERRED EMBODIMENTS

All dimensions listed, all manufactures listed (for example Warner Electric, Labtech, etc.), and all materials used (such as brass, aluminum, plywood, plastic etc.), in this application are given by example, and not by way of limitation.

Figure 1:
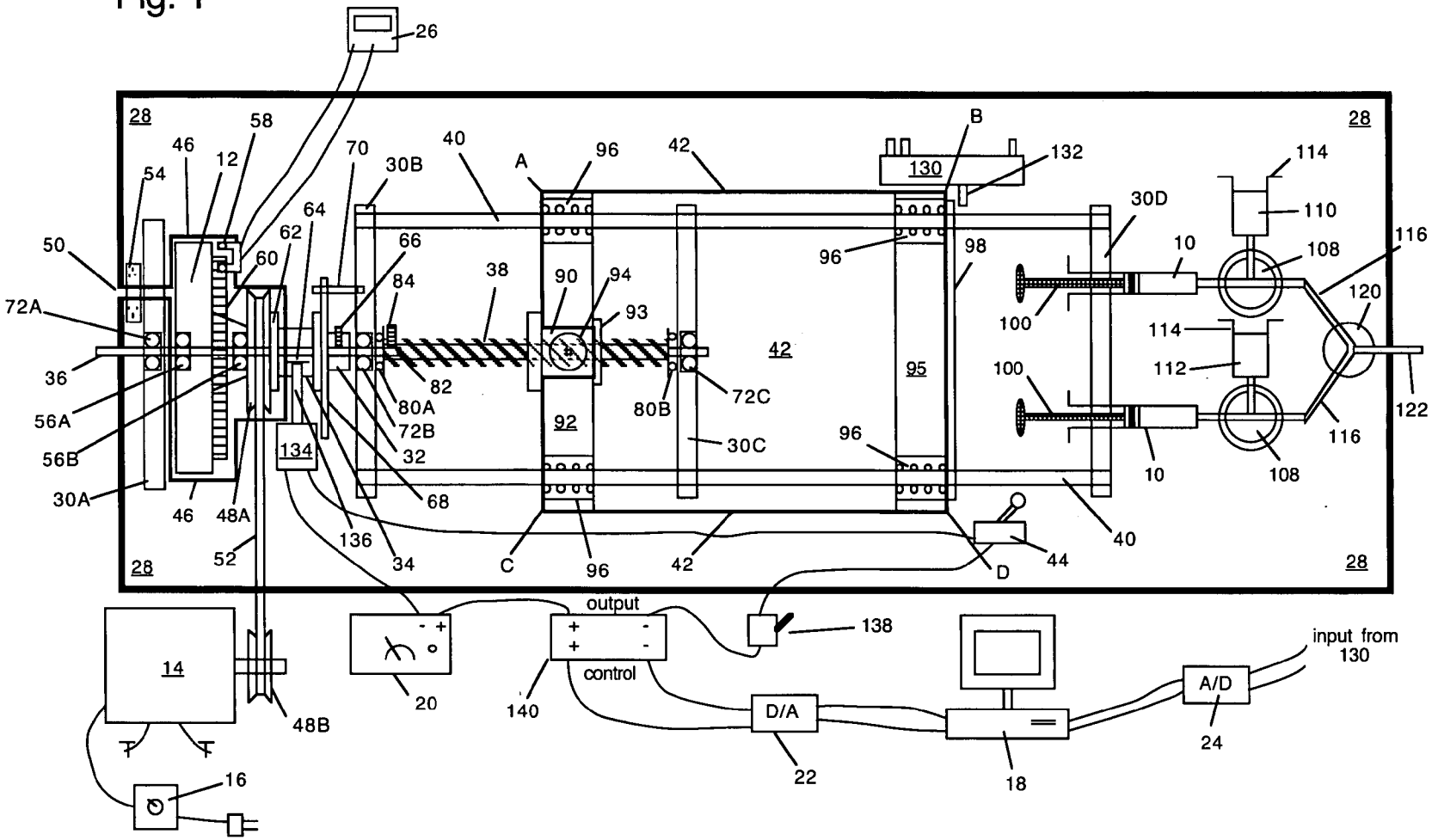
FIG. 1 is a top view of a wrap spring clutch syringe ram in accordance with the present invention.

FIG. 1 presents a top view of a wrap spring clutch syringe ram. The syringes 10 are mounted at the front of the ram, and the flywheel 12 is mounted toward the rear of the ram. The flywheel 12 has substantial mass. The entire ram apparatus (except for the motor 14, DC motor speed control 16, computer 18, power supply 20, D/A converter 22, A/D converter 24, tachometer 26, and a few ancillary items, such as batteries, not shown in FIG. 1 are preferably mounted on a ½ inch thick aluminum platform 28 of dimensions 46½ inches long by 13 inches wide. In FIG. 1, the top surface of this aluminum base 28 may be regarded as the plane of the sheet of paper. The ram itself is mounted firmly to the top of the aluminum platform 28 with twelve nylon screws (not shown) which pass upwards from the underside of aluminum platform 28, through twelve small holes drilled through the aluminum sheet 28, and thence into holes drilled and tapped into the bottom of the four base supports 30A-30D. Nylon screws are used rather than metal screws, in hopes that the nylon screws will flex or break should any accidents occur with the ram. The position and alignment of these 12 holes in the aluminum sheet 28 is critical to the alignment and function of the ram, so these holes were drilled by first mounting the base aluminum sheet 28 on a Bridgeport milling machine. The total length of the ram, itself, from the back of support 30A to the front of support 30D is 30¾ inches. The distance from the back of support 30B to the front of support 30D is 24 inches. The distance from the back of the flywheel 12 to the front of the output hub 32 of the wrap spring clutch 34 is 5½ inches. The front of output hub 32 is ¼ inch from the back of support 30B. The distance from the front of support 30B to the back of support 30C is 6¾ inches. The centerline of the stainless steel shaft 36 and of the lead screw 38 is ¾ inch above the top of the aluminum platform 28. The centerlines of the two parallel shafts 40 are also ¾ inch above the top of the aluminum platform 28. The top of moving platform 42 is 2 inches above the top of stationary platform 28, and moving platform 42 is 18 inches long by 8¼ inches wide by ¼ inch thick. The safety limit switch 44, and the linear potentiometer 130 are mounted with screws to the base aluminum sheet 28, also, and adjacent to moving platform 42 of the ram, as shown. A large hole 46 (thicker, dark line) is cut through the aluminum sheet to allow the 9 inch diameter flywheel 12 and the pulley 48A to extend through and below the aluminum sheet, and to rotate. A slot hole 50 (also thicker, dark line) through the aluminum platform 28 extends outward from the hole 46 for the flywheel and pulley 48A to the outer periphery of the aluminum sheet 28, to enable the v-belt 52 to be placed onto and around the pulley 48A and thereby to enable the v-belt 52 to extend from the hole 46, both above and below the aluminum platform 28 when joining the pulley 48A to the pulley 48B of the externally mounted motor 14. Once the v-belt 52 is in place, the slot 50 is covered with a removable ¼ inch thick aluminum plate 54 which rigidly is screwed to top of the base aluminum sheet 28, to strengthen the area of the slot 50 The aluminum platform sheet 28 rests upon, and is bolted to wooden 4×4's (not shown), and the 4×4's rest upon and are bolted to an undergirding ¾ inch thick sheet of exterior grade plywood (also not shown). The electric motor 14 is mounted rigidly to the top of the undergirding ¾-inch-thick sheet of plywood, with the motor 14 to the side of, and with its centerline approximately ¾ inch below the upper plane of, the aluminum sheet 28. Immediately prior to tightening the bolts which hold the motor 14 to the plywood sheet, the position of the motor 14 is adjusted with slots (not shown), so that the pulleys 48B and 48A are aligned, and the v-belt 52 is at the appropriate tension.

The ram is composed of an electric motor 14 which drives a flywheel 12. Satisfactory operation has been found by employing either a ⅓ horsepower, 110 VAC, General Electric AC motor, model SKC42JG25E, or a variable speed ¼ horsepower General Electric DC motor, model 5BC 38PD1, controlled with a MagneTek W713 DC motor speed control 16. Input to the DC controller is 220 VAC, which yields twice the maximum horsepower of the DC motor compared with use of 110 VAC. Stepper motors, or motors of any type, also may be suitable. In our present system the output shaft of the motor 14 drives the flywheel 12 by pulley system 48A, 48B, joined by a v-belt 52. Direct, or in-line, or geared, or chain, or notched belt, or variable speed gearbox, etc., drive systems may be preferred. The flywheel is preferably fabricated from 9 inch diameter×1.75 inch thick piece of aluminum. The flywheel 12 is balanced, and rides upon a ¼ inch diameter stainless steel shaft 36 via ball bearings 56A and 56B which are pressed fit into the center of the rear and front sides of the flywheel. Attached rigidly to the front side of the flywheel is the pulley 48A, and on the front side of the pulley 48A is mounted the rear input hub of the wrap spring clutch 34. The pulley 48A and the rear input hub 62 of the wrap spring clutch 34 additionally are supported by an internal bearing (not visible) of the wrap spring clutch 34. The velocity of the flywheel is adjusted by the ratio of the pulleys 48A 48B, or by adjusting the velocity of the DC motor 14 with speed control 16. The speed is monitored either by a calibrated stroboscope (not shown), or with a tachometer 26 coupled to a slotted photo interrupter 58. The flywheel is fitted on its front side with a protruding ring 60 fitted with a series of twenty-five evenly spaced slots. The slotted ring 60 fits into the slot of the slotted photo interrupter 58, between the light source and photo detector of the photo interrupter 58.

On the front side of the flywheel is attached the pulley 48A, and the pulley 48A is mounted rigidly to the rear input hub 62 of the wrap spring clutch 34. Note that the flywheel 12, pulley 48A, and the rear input hub 62 of the wrap-spring clutch 34 are bolted together (with three long machine screws—not shown) to form a single unit, through which the ¼ inch diameter stainless steel shaft 36 passes. The flywheel 12, pulley 48A, and the rear input hub 62 of the wrap spring clutch 34 spin together as a single unit, on ball bearings 56A and 56B, and on the internal bearing (not visible) of the wrap spring clutch 34. Shaft 36, lead screw 38, plus front output hub 32 and stop collar 64 of the wrap spring clutch 34, usually are stationary, however whenever the wrap spring clutch 34 is engaged, stop collar 64, the front output hub 32, shaft 36, and lead screw 38 rotate together with the flywheel 12, pulley 48A, and rear input hub 62. Model CB-2 wrap spring clutch 34 is manufactured by Warner Electric. There are many models, sizes, and manufacturers of wrap spring clutches; units of other sizes from Warner Electric, or wrap spring clutches from other manufacturers also may be suitable. The wrap spring clutch 34 employs a 2-stop collar 64. This collar 64 preferably has two equally spaced stop notches per one rotation, meaning that the clutch may be engaged for a minimum of ½ rotation. Several other stop collars are available from Warner Electric, ranging from 1-stop to 24 equally spaced stops and may be substituted. Clutches fitted with these collars can be engaged for a minimum of 1 rotation, or 1/24th rotation, respectively. Or stop collars, perhaps with unequally spaced stops, or a nonstandard number of stops, etc., may be custom made. The front output hub 32 of the wrap spring clutch 34 is attached rigidly to the central ¼ inch diameter stainless steel shaft 36, by one Allen screw 66, so that when output hub 32 rotates, shaft 36 rotates. When shaft 36 rotates, shaft 36 turns lead screw 38. The front mounting plate 68 of the wrap spring clutch is restrained from rotating by a pin 70. Pin 70 is rigidly mounted with screw threads into the rear of stationary mount 30B. Pin 70 is inserted through a hole in the mounting plate 68, such that movement of the mounting plate 68 is not restrained axially. This method of mounting is recommended by Warner Electric because it prevents rotation of the mounting plate 68 while reducing the load on the internal plate bearing (not visible) of the clutch 34.

Starting from the rear of the ram assembly, the ¼ inch diameter stainless steel shaft 36 passes through ball bearing 72A, which is pressed fit into end support 30A. Shaft 36 then passes through ball bearing 56A at the rear of the flywheel 12, and through ball bearing 56B at the front of the flywheel 12. Shaft 36 continues through the flywheel 12, pulley 48A, and the rear input hub 62 of the wrap spring clutch 34, all three of which are rigidly bolted together to form a single assembly, as previously mentioned. After passing through the wrap-spring clutch assembly, shaft 36 then passes through ball bearing 72B which is pressed fit into a hole which is machined part-way into the back side of, but not through, support 30B. Shaft 36 then passes through a smaller diameter hole (circa ¼ inch diameter) drilled the remainder of the way through support 30B, and thence through thrust bearing 80A on the front face of support 30B. The front end of shaft 36 extends into and terminates in a hole 82 drilled into the rear of the lead screw 38. In our design, the ¼ inch diameter stainless steel shaft 36 is a separate piece from the lead screw 38. A ¼ inch diameter hole 82 is drilled into the center, rear, of lead screw 38. Shaft 36 is held firmly within hole 82 of lead screw 38 by an Allen screw 84, such that shaft 36 and lead screw 38 rotate together as a single unit. Lead screw 38 is an acme screw of 316 stainless steel, machined by us on a Hartridge Lathe. The outside diameter of lead screw 38 is ½ inch, and its pitch is 4 turns per centimeter. A more expensive, precision stainless steel ball screw fitted with a preloaded ball nut probably would be superior to our stainless steel acme screw in this application. Lead screw 38 passes through brass nut 90 which is of internal diameter ½ inch, and is threaded on its inside diameter at pitch 4 turns per centimeter. Brass nut 90 is 0.915 inch in outer diameter, is round on its outer circumference, and is machined to fit closely within a hole of 0.915 inch internal diameter drilled axially from the rear to the front through aluminum moving block 92. The lead screw next passes through brass front end piece 93 which is held to the front face of Brass nut 90 with screws. The brass nut 90 is prevented from rotating and is held firmly within aluminum moving block 92 by a removable, round, brass pin 94 which fits snugly into a ¾ inch diameter hole drilled into the top of moving block 92. A smaller diameter extension on the bottom center of pin 94 extends snugly into a ¼ inch diameter hole drilled into the top of brass nut 90. Thus removable pin 94 firmly holds nut 90 within moving block 92, and prevents nut 90 from rotating when acme screw 38 rotates. Removable pin 94, brass nut 90, front end piece 93, and moving block 92 will be described in more detail in FIGS. 7A-7E.

The front ½ inch of lead screw 38 is machined to ¼ inch diameter. The front end of lead screw 38 passes through thrust bearing 80B, and through a small hole (circa ¼ inch diameter) drilled through support 30C. The front end of lead screw 38 then passes through ball bearing 72C which is pressed fit into a hole machined part-way into the front side of, but not through, stationary support 30C.

The remainder of the apparatus includes a precision slide with precision syringes and a rapid-mixing device mounted in front of the slide. Passing through supports 30B, 30C, and 30D are two, parallel, two-feet-long, ⅜-inch diameter, precision-ground, hardened steel shafts 40. These shafts are 7⅜ inches apart, center to center. These two hardened shafts 40 additionally pass through linear ball bearings 96 which are pressed fit into holes drilled through moving block 92 and push block 95, near the outer edges of blocks 92 and 95 in the positions shown. Sleeve bushings also can be substituted for the linear ball bearings 96. Rigidly mounted with screws atop moving block 92 and push block 95, and joining the two blocks rigidly together is a ¼-inch-thick aluminum sheet of dimensions 8⅛ inches wide, by 18 inches long, which forms a moving platform 42. Platform 42, designated in FIG. 1 by a thicker peripheral line, is attached to, joins, and covers both moving blocks 92 and 95. Platform 42 joins, spans, and covers points A, B, C, and D. Platform 42 does not make contact with support 30C, or with shafts 40. The platform 42 glides on the linear roller bearings 96 within moving block 92 and push block 95 as they glide along the shafts 40, as moving block 92 is driven by rotation of the lead screw 38 within nut 90. The platform 42 is longer than it is wide to reduce significantly side-to-side wobble of the platform 42 as it moves along the shafts 40.

Figure 2:
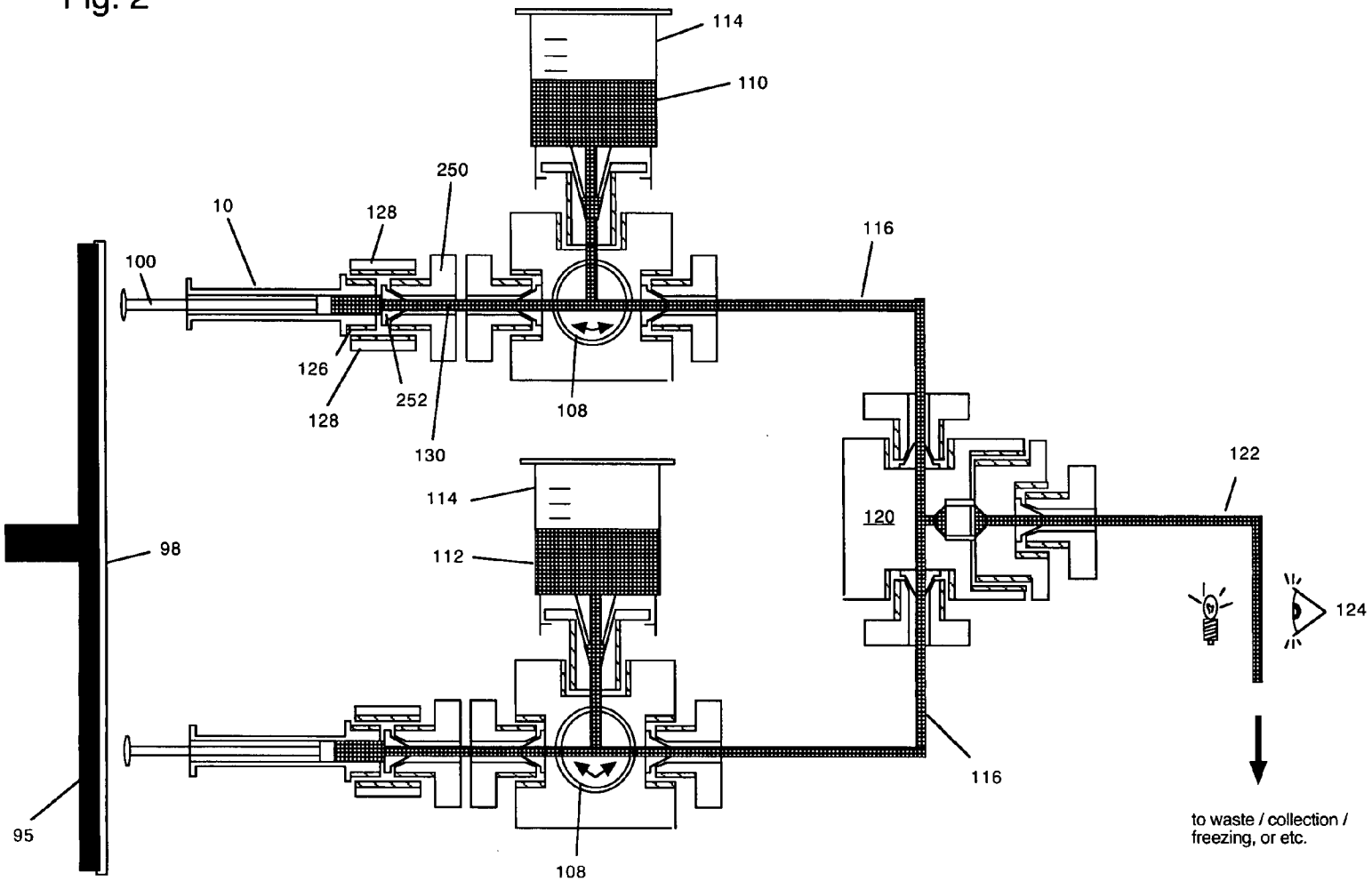
FIG. 2 is a top view of the mixing section of a wrap spring clutch syringe ram and frit mixer in accordance with the present invention.

At the front of the platform 42 and on the front face of the push block 95 is mounted a flat, ⅛ inch thick aluminum plate 98. The plate 98 is positioned to push the plungers 100 of the syringes 10. Any number of syringes 10 may be used, and these syringes 10 are mounted securely onto or in front of support 30D. With reference to FIG. 2, it is preferable to use 1 ml, or 0.5 ml "C"-type Hamilton gas-tight syringes 10 in our application. The "C"-type syringe is equipped with a male, threaded ¼"-28 fitting 126, which enables leak-tight coupling of this syringe to lines, mixers, etc. In FIG. 2*a* ¼"-28 male fitting 126 of a "C"-type Hamilton syringe is joined to a section of 1/16" O.D. stainless steel tubing 130 by means of an internally threaded union 128, a ferrule 252, and a ¼"-28 Upchurch male fitting 250.

Figure 3:
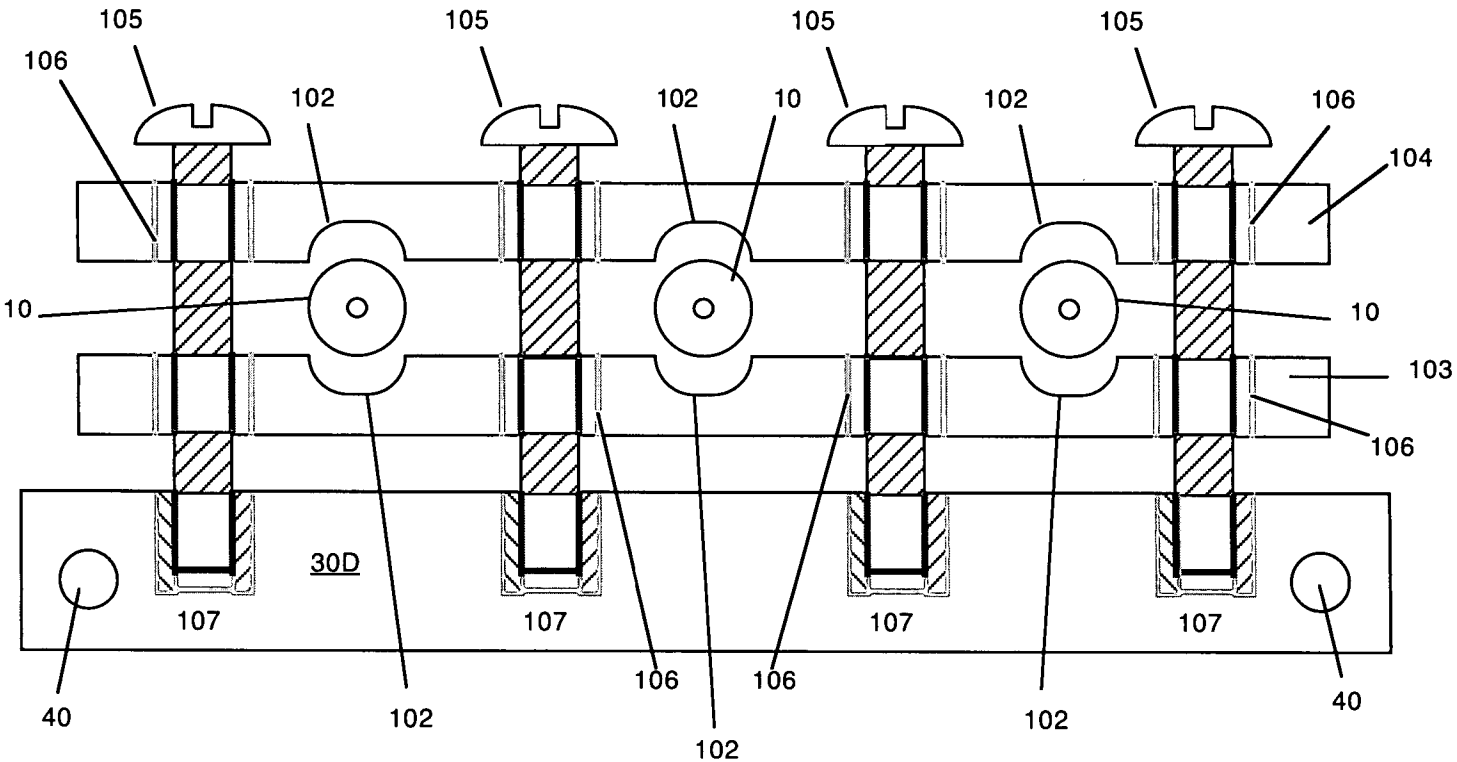
FIG. 3 is an end view of a clamping device for mounting syringes at a front of a syringe ram of a wrap spring clutch syringe ram and frit mixer in accordance with the present invention.

With reference to FIG. 3, the syringe mounts are constructed by drilling holes 102 of slightly smaller diameter than the syringe barrels 10 through a flat sheet of plastic. The plastic sheet then is cut in half, such that the holes 102 are cut in half longitudinally. One half 103 of the plastic piece is laid below the syringe barrel(s) 10, and the second half 104 is placed above the syringe barrel(s) 10 with each syringe barrel resting in the hole that was drilled for it. Machine screws 105 then are passed through additional holes 106 drilled vertically through the plastic mounting pieces (only five of the eight vertical holes 106 are labeled in FIG. 3). The holes 106 are of slightly larger internal diameter(s) than the external diameter(s) of the threaded portion(s) of the machine screws 105. These screws 105 extend into tapped holes 107 drilled into the top of end support 30D. The upper 104 and lower 103 plastic pieces then are tightened firmly together and firmly to the top of support 30D by tightening the machine screws 105 into the threaded holes 107, thus clamping the syringe barrel(s) 10 securely in place. The ends of the ⅜ inch diameter shafts 40, that pass into piece 30D are displayed in FIG. 3, as well.

With reference to FIGS. 1 and 2, the outlet of each syringe 10 is connected to a three-way valve 108. Three types of small volume, three-way valves have been employed. All three types work suitably at the pressures generated within the system. One is a three-way valve with a tapered, Delrin, rotating central stem. A six-port, Rheodyne HPLC valve is modified to enable its use as a dual three-way valve. A modified 4-port, Upchurch V-100T, injection-molded, 3-way switching valve may also be used. When rotated to the appropriate position, each three-way valve 108 enables filling of its attached syringe with the designated reactant solution 110, 112 contained in its reservoir 114. Prior to activating the ram, both three-way valves 108 are manually rotated appropriately, to isolate their respective reservoirs 114, and to enable the contents of each syringe 10 to empty through its line 116 to the mixer 120 when the plungers 100 simultaneously are pushed by the ram. After exiting the mixer, the mixed solutions travel through reactor line 122. FIG. 2 shows the frit mixer 120, and additionally a detector 124 placed along reactor line 122. The detector 124 often is a spectrophotometer, or may be a mass spectrometer equipped with a flow-through membrane inlet, etc. Alternatively, the solution exiting the reactor line may be quenched chemically, or by freezing, etc., and saved for analysis.

With reference to FIG. 1, the motion and position of the moving platform 42 are monitored with a linear potentiometer 130. The linear potentiometer 130 is mounted such that its tang 132 can be pushed by front piece 98 (which is mounted to the front of push block 95) as the platform 42 moves forward. The linear potentiometer 130 is mounted on a base containing slots (not shown), so that the body of the linear potentiometer 130 can be repositioned axially along the side of the platform 42, and remounted securely to the aluminum base 28 by retightening the same screws. The analog output from the linear potentiometer 130 is fed into an A/D converter 24 and thence into a computer 18 for storage and later analysis. The electrical connections to and from the linear potentiometer 130 will be described below, with reference to FIG. 4, together with the analog to digital input A/D converter board 24.

Figure 5:
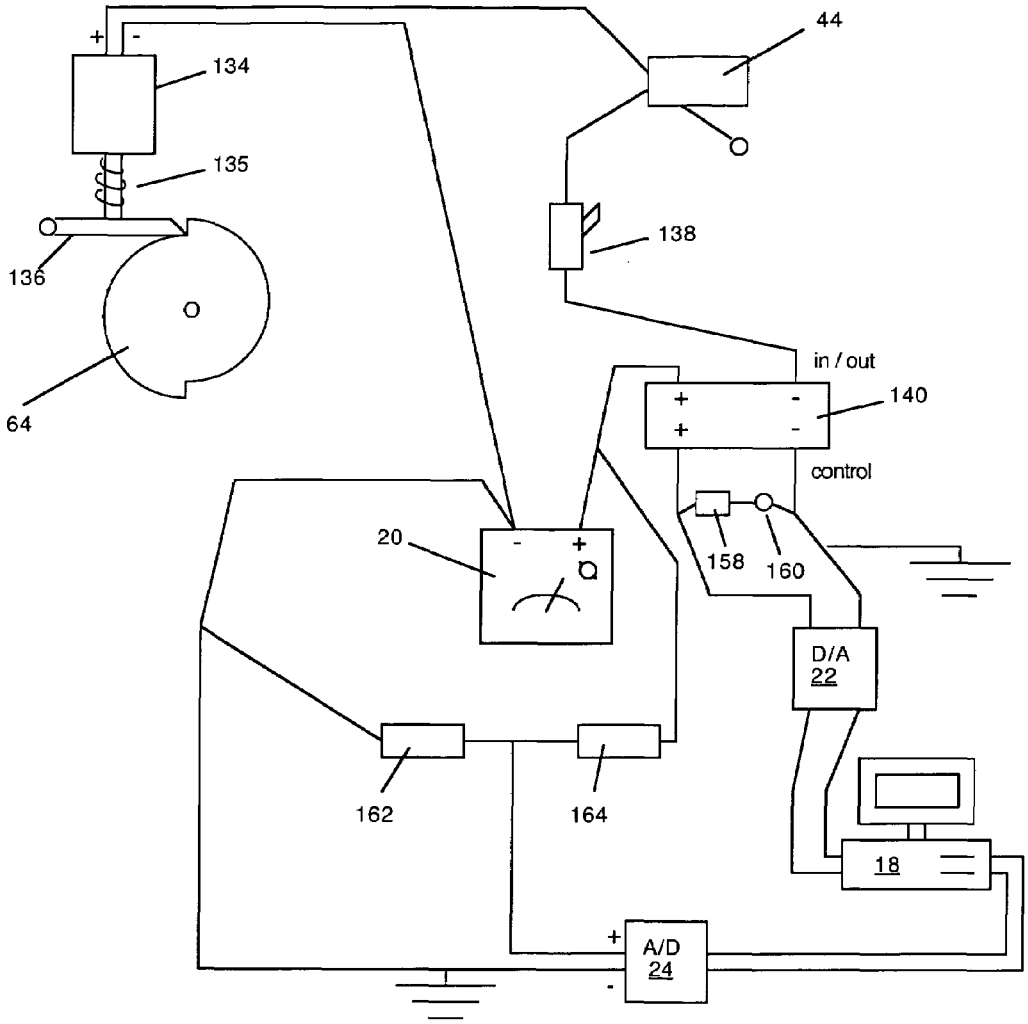
FIG. 5 is a schematic diagram of a solenoid of a wrap spring clutch, trigger D/A output circuit, and computer in accordance with the present invention.

To activate the wrap spring clutch 34, a solenoid 134 is used. The CB-2 wrap spring clutch was fitted by Warner Electric with a 24 volt DC solenoid. A 44.2 volt DC pulse of electricity from the power supply 20, to the solenoid 134 causes the solenoid 134 to retract and to lift the spring-loaded pivot arm 136 which had been preventing the stop collar 64 from turning. The arrangement of the solenoid 134, pivot arm 136, and stop collar 64 are shown in FIG. 5. The moment at which the stop collar 64 is released, the clutch 34 begins to engage. The clutch 34 will remain engaged for as long as the solenoid 134 remains charged, and until the sprung pivot arm 136 again lowers and engages a stop of the collar 64. Turning off power to the solenoid 134 will cause the sprung pivot arm 136 to drop and to engage one of the two notches of the stop collar 64; this action disengages the clutch 34. As the clutch 34 disengages, the stop spring within the clutch wraps down on the output hub 32 of the clutch. Further rotation of the lead screw 38, and further advance of the ram platform 42, cease within 1.5 msec.

Both fractional and multiple rotations of the lead screw are possible, depending upon the number of stops on the collar 64, the rotational velocity of the flywheel 12, and the length of time for which the solenoid 134 remains energized. For example, if the solenoid 134 remains charged indefinitely, then the clutch will remain engaged indefinitely also, and the ram will push to the end of its travel. To prevent the broken syringes (and fingers!) which can result from such an unfortunate mishap, we have included a safety limit switch 44. When safety limit switch 44 is opened by contact with the front plate 98 of the ram platform, this opened switch 44 immediately disconnects power to the solenoid 134, thereby quickly disengaging the clutch 34, and halting further forward motion of the ram platform 42. The manual on-off switch 138 can be used similarly to stop the ram, provided that the reflexes of the operator are quick enough. A mechanical safety feature which could be used on the ram is to machine a section of the threads off the front portion of the lead screw 38, or to move support 30C a couple of inches forward, such that nut 90 can travel safely beyond the front end of the lead screw's thread. Then the ram platform 42 would be unable to advance with force beyond a safe, predesignated position.

Figure 4A:
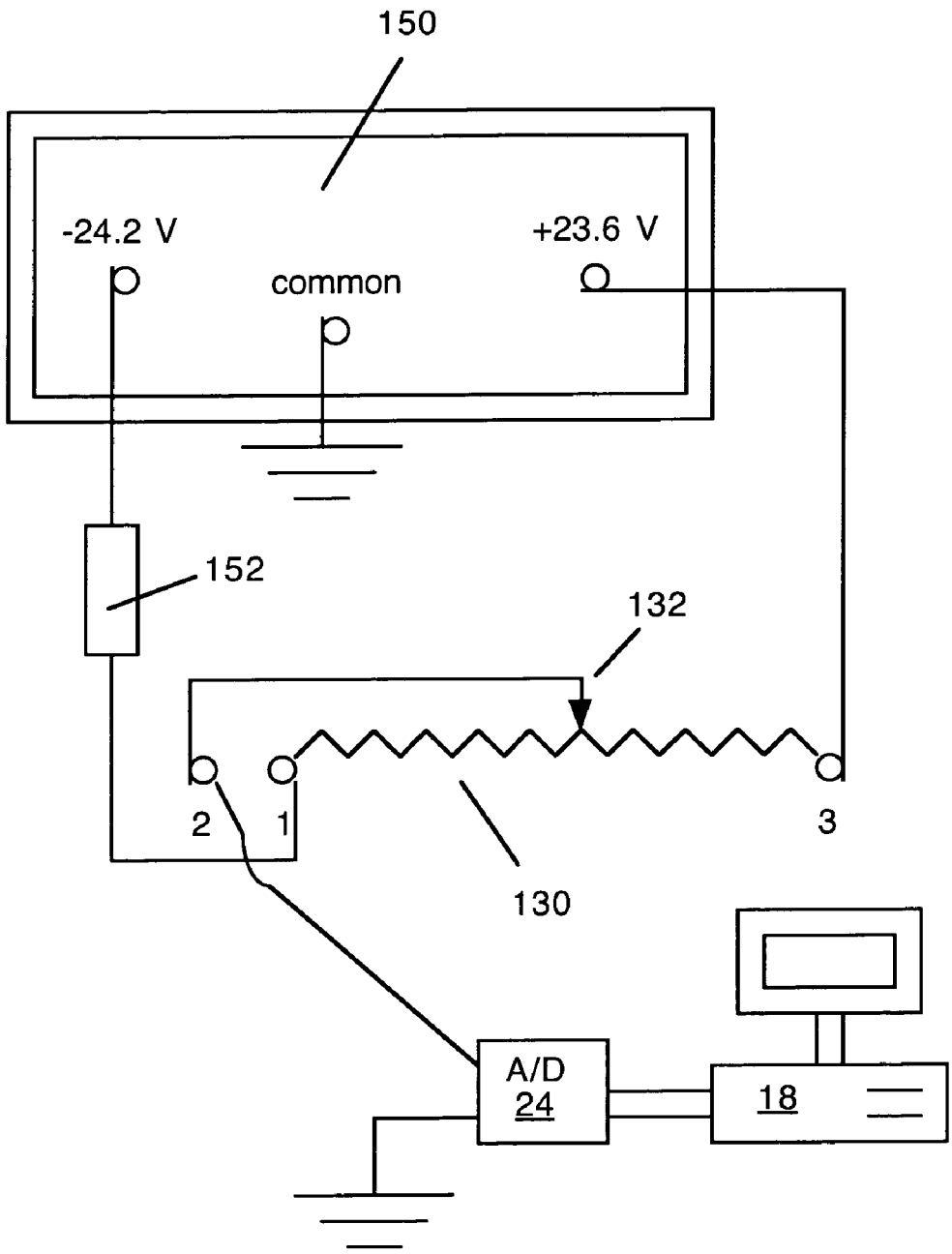
FIG. 4A is a schematic diagram of a computer, A/D converter, and linear potentiometer powered by a 24 volt supply in accordance with the present invention.
Figure 4B:
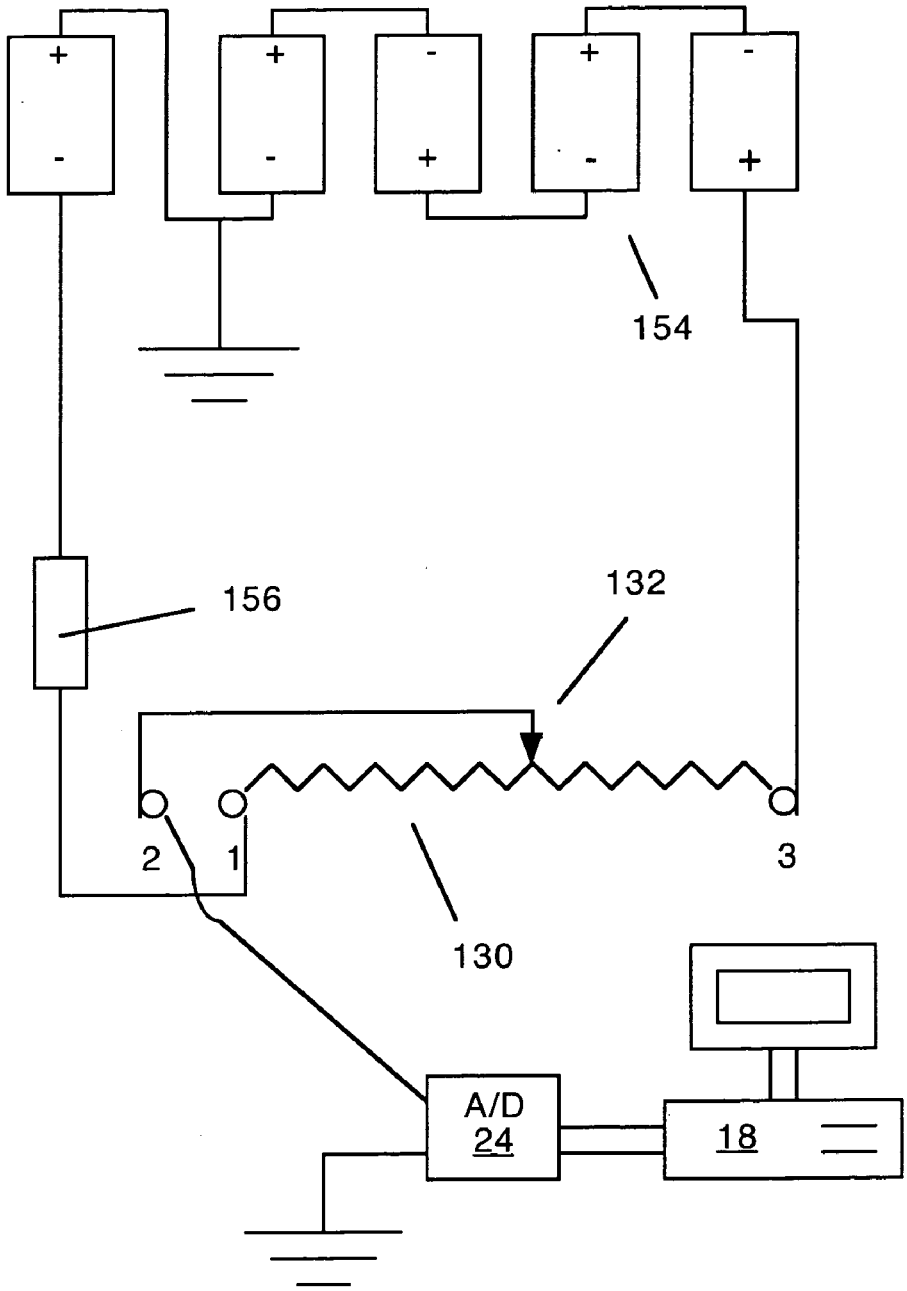
FIG. 4B is a schematic diagram of a computer, A/D converter, and linear potentiometer powered by five 6-volt batteries in accordance with the present invention.

FIGS. 4A-4B and 5 show diagrams of the electronics which control and enable monitoring of the wrap spring clutch syringe ram. Electrical connections to the solenoid 134 of the wrap spring clutch include the power supply 20, the solid state relay 140, the manual on-off switch 138, the safety limit switch 44, the digital to analog output (D/A) board 22, and the computer 18. The aluminum plate 98 attached to the front of block 95 of the ram platform 42, pushes not only the syringe plungers 100, but also the sliding tang 132 of the linear resistor 130.

The circuitry connecting to and from the linear potentiometer 130 is depicted in FIGS. 4A and 4B. The linear potentiometer 130 when coupled with the time base of the computer enables us to monitor the position of the ram with respect to time. The linear potentiometer 130 presently used on the machine is a 10 K ohm, Model 422 DD, Slideline potentiometer manufactured by Duncan Electronics, Inc., Costa Mesa, Calif., USA. It may be powered from a home-built power supply 150 (FIG. 4A), which delivers +24 and −24 volts DC relative to a commonly grounded terminal. Connecting the linear potentiometer 130 to the power supply, with inclusion of an additional 6800 ohm resistor 152 between the −24 Volt terminal of the power supply, and terminal 1 of the linear potentiometer, as shown, enables adequate motion-to-voltage response, together with use of the full 4096, 12 bit ($2^{12}$) range of the analog to digital (A/D) converter 24 which is installed in a 386/40 MHz computer 18. A plug-in, Labtech PCL 711 A/D—D/A board with 8 input channels is used, and each input channel responds to analog input voltages between −5 and +5 volts.

Five 6 volt, sealed, rechargeable lead acid batteries 154 may connected as shown in FIG. 4B to power the linear potentiometer 130. A 100 ohm resistor 156 is inserted between the negative terminal of the last battery, and pin 1 of the linear potentiometer 130. It has been found that the batteries 154 provide a slightly quieter source of power compared to the power supply 150.

With reference to FIG. 5, the computer sends a 5 volt pulse, on que, from the Labtech PCL 711 digital to analog (D/A) converter board 22 to the control terminals of the solid state relay 140. A Crydom relay is used with ODC, 5A AC output, DC output 1A at 200VDC, DC control 2.5–8 VDC, #429105. Across the control leads of the relay 140, a 560 ohm resistor 158 has been included and an LED 160, which blinks when the computer sends an output pulse. The negative output terminal of the relay 140 is connected to one terminal of a manual on-off switch 138, which also can serve as a manual safety shut-off switch. To the second terminal of this on-off switch 138 is connected an adjustable position safety limit switch 44. This safety limit switch 44 is affixed to a base containing mounting slots (not shown), such that this switch 44 may be moved axially adjacent to the platform of the ram, and positioned such that when and if the front of the ram platform 42 moves too far forward, such that further forward motion of the ram risks the breaking of syringes, etc., the safety limit switch will be tripped open by the front plate 98 of the ram. Once the safety limit switch is tripped open, power to the ram solenoid immediately is switched off, thus disengaging the wrap spring clutch, and quickly halting further forward motion of the ram.

Extending from the second terminal of the safety limit switch 44 is a lead wire that connects to the solenoid 134 of the wrap spring clutch. The other terminal of the solenoid 134 is connected with a wire to the negative terminal of the 44.2 volt DC power supply 20. A second circuit loop joins the negative and positive terminals of the power supply 20, along which are an 1100 ohm resistor 162 and a 10,000 ohm resistor 164 as shown (FIG. 5). Between the resistors, a lead is connected, and this lead joins to one of the eight A/D converter input channels 24. This arrangement allows monitoring with the A/D converter 24 and the computer 18, when the 44.2 volt pulse of DC power is delivered from the power supply 20 to the solenoid 134 of the wrap spring clutch 34. Ground connections are as shown in FIG. 5.

When a 0.004 second pulse is sent from the computer 18 through the D/A converter 22 to the control side of the relay 140, and if the front plate 98 of the ram has not yet reached the safety limit switch 44, and if the manual on-off switch 138 is in the "on" position, then the solid state relay 140 will trigger, sending a 0.004 second, 44.2 volt DC pulse from the power supply 20 to the solenoid 134 of the wrap spring clutch 34. The solenoid 134 thereby is energized, compressing the return spring 135 and lifting the pivot arm 136, away from the stop of the stop collar 64. When the stop collar is released, the clutch engages. At 1200 rpm, a 0.004 second, 44.2 volt DC pulse energizes the solenoid for a time shorter than 25 msec, such that the sprung pivot arm 136 is able to return to touch the collar 64 rapidly enough to catch the next stop of the collar 64 within ½ revolution. The result is a precise ½ turn of the lead screw 38 of the ram; the moving platform 42, and the syringe plungers 100 are displaced forward ⅛ centimeter, ejecting a droplet of solution from each of the syringes. The 0.004 second pulse delivered from the power supply 20 to the solenoid 134 simultaneously is recorded through an input channel of the A/D converter 24, and the digitized signal is stored by the computer 18 on its hard disk. If desired, a longer pulse from the computer can lead to a longer push of the ram. The ram always pushes in units of ½ rotation, due to our use of a 2-stop collar. Use of single stop, or other multiple stop collars would lead to pushes of different lengths.

Figure 6:
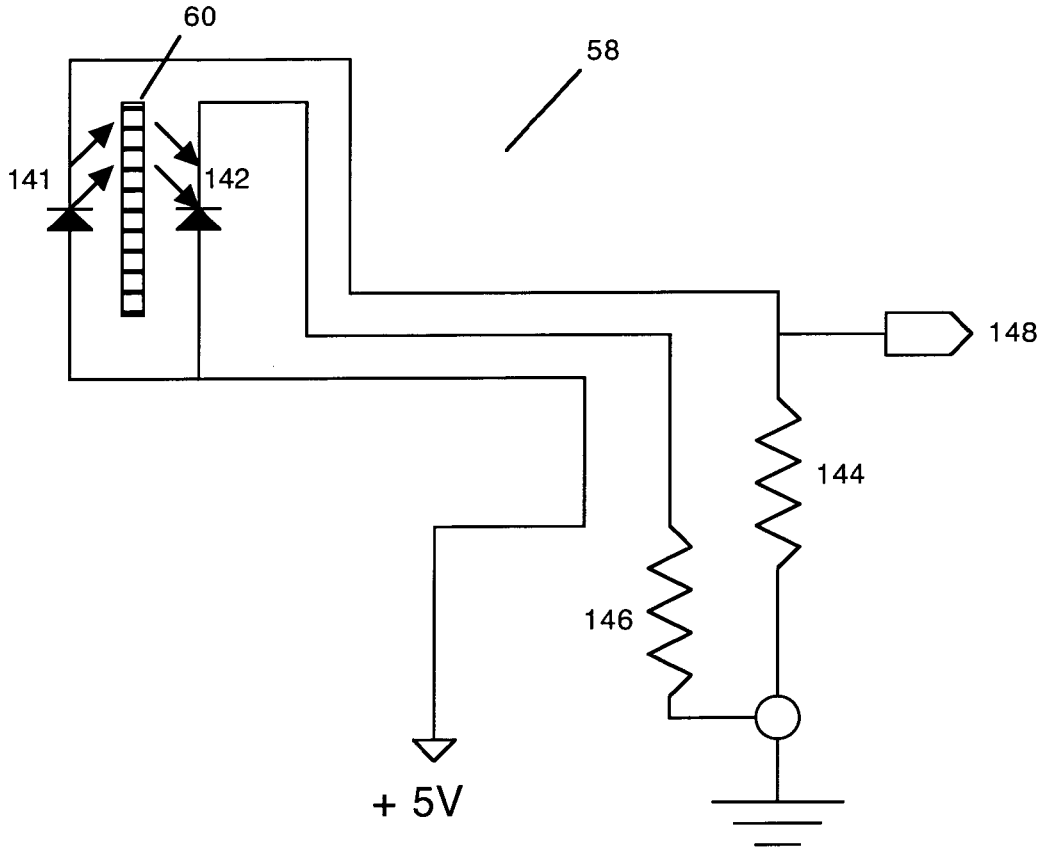
FIG. 6 is a schematic diagram of a slotted photo interrupter, which serves to monitor the speed of the flywheel in accordance with the present invention.
Figure 7A:
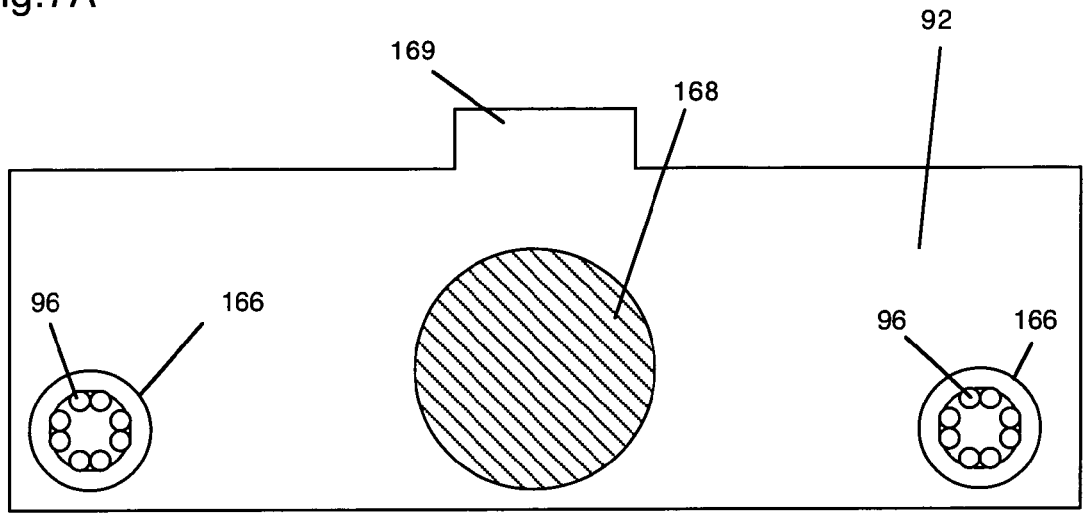
FIG. 7A is an end view of a rear moving block of a wrap spring clutch syringe ram and frit mixer in accordance with the present invention.
Figure 7B:
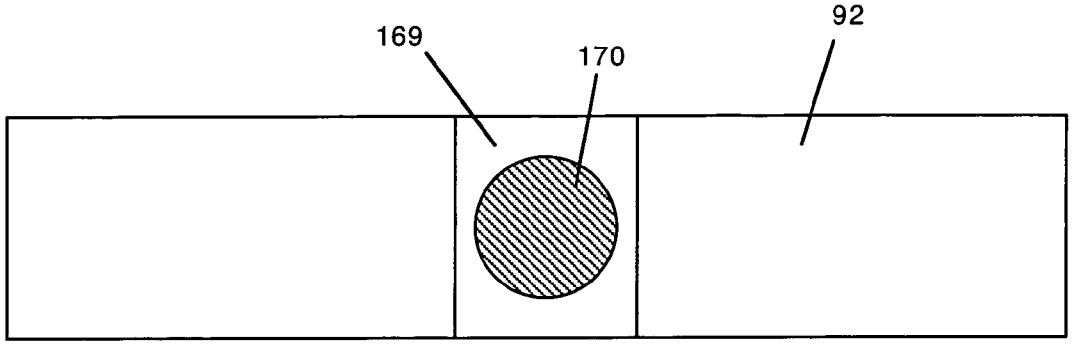
FIG. 7B is a top view of a rear moving block of a wrap spring clutch syringe ram and frit mixer in accordance with the present invention.
Figure 7C:
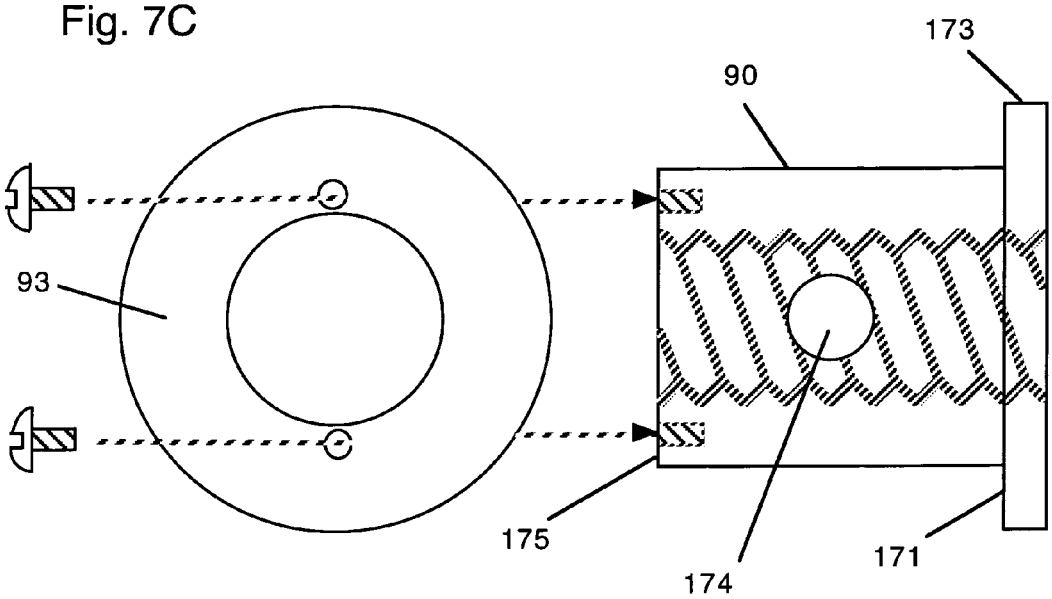
FIG. 7C is an end view of a front brass end piece which attaches with screws to a front of a threaded brass nut of a wrap spring clutch syringe ram and frit mixer in accordance with the present invention, together with a top view of a threaded brass nut of a wrap spring clutch syringe ram and frit mixer in accordance with the present invention.
Figure 7D:
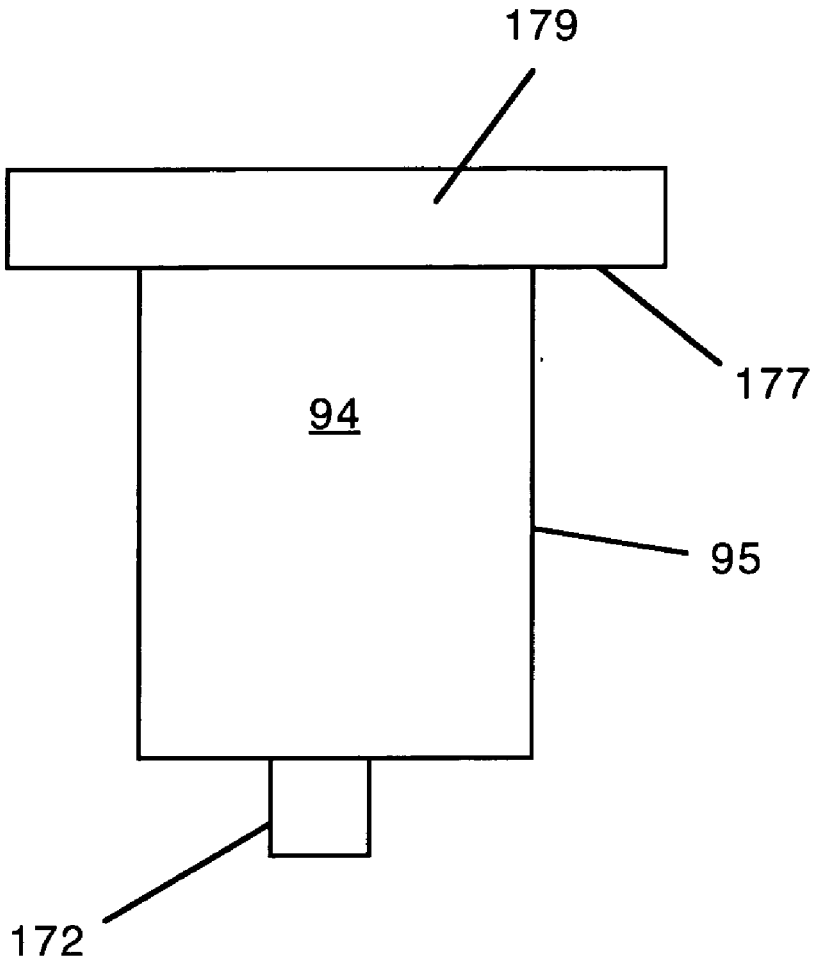
FIG. 7D is a side view of a removable brass locking pin of a wrap spring clutch syringe ram and frit mixer in accordance with the present invention.
Figure 7E:
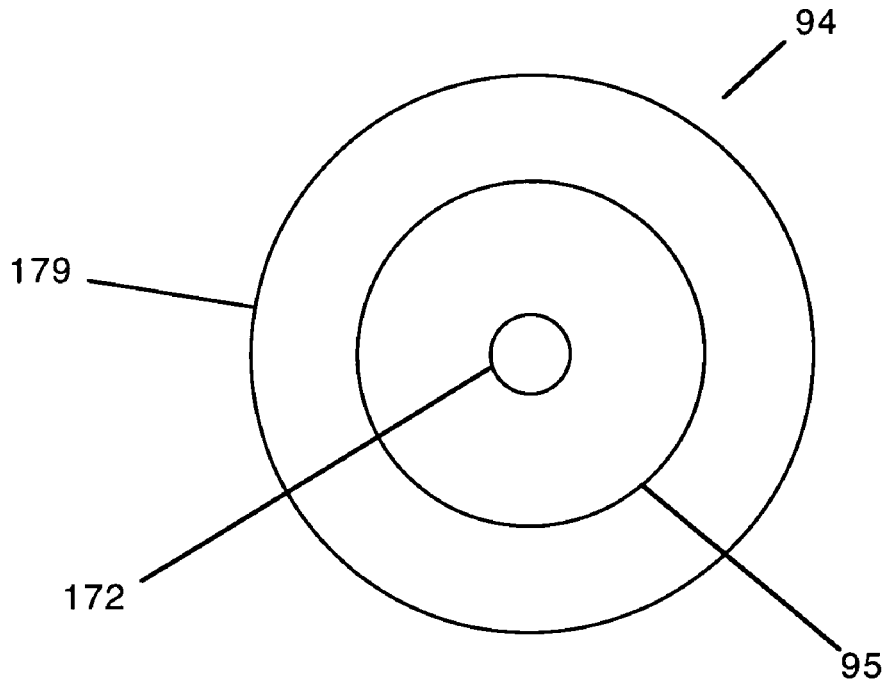
FIG. 7E is a bottom view of a removable brass locking pin of a wrap spring clutch syringe ram and frit mixer in accordance with the present invention.

The circuit diagram of the slotted photo interrupter 58 is shown in FIG. 6. A separate 5 volt DC power supply is employed. Light emitted from the light emitting diode (LED) 141 is collected by the phototransistor 142. With photointerrupter 58 properly mounted in position next to the flywheel 12, the slotted ring 60 which protrudes from the flywheel 12 is located between the LED 141 and the phototransistor 142. As the flywheel 12 rotates, the slots of the slotted ring 60 interrupt momentarily and repeatedly transmission of light from the LED 141 to the phototransistor 142. The resulting electrical pulses pass through the circuit of FIG. 6, which includes a 2200 ohm resistor 146, and a 200 ohm resistor 144, to produce an output signal 148. The detected output signal 148 can be stored by the computer 18, via an input channel of the A/D converter 24, or fed into a counter-timer, frequency counter, or tachometer 26 to clock the rotational velocity and performance of the flywheel 12.

A calibrated strobe light (Strobotac type 631-BL, General Radio Company, Cambridge, Mass.) is used to monitor the velocity and relative position of the flywheel 12. Another accurate method to determine the velocity and position of a spinning flywheel is to place a known number of equally spaced dots around the periphery of his flywheel, and to use the known cycle rate of fluorescent lighting of 7200 cycles per minute to clock the speed.

A Tektronix Inc. Type RM564 storage oscilloscope equipped with a plug-in Type 3A9 differential amplifier and a plug-in Type 2B67 timebase can be used to record the output traces of the linear potentiometer 130. Any suitable recording oscilloscope can be used successfully in place of the A/D converter and the 386/40 Megahertz computer to record and to measure these and other fast responses.

The computer performs two functions, 1) analog to digital input, and 2) digital to analog output, both through a Labtech PCL 711 board equipped with a 12-bit A/D, D/A converter. The 711 board has inputs for up to 8 analog channels, designated 0 through 7. Only one of the D/A outputs need be used for controlling the solenoid of the wrap spring clutch syringe ram. Other A/D—D/A data acquisition boards, software, and computers could be tailored to control the wrap spring clutch syringe ram to suit one's needs.

The user interface enables access to and interaction with the software. The computer 18 can collect up to 10,000 samples per second from each of eight A/D input channels and can send four D/A output signals, all simultaneously. As an example, the computer 18 will collect 8000 samples from each of three A/D input channels, 0, 1, and 2, at a frequency of one sample every 0.001 second per channel. The remaining 5 input channels will not be sampled. Sampling will occur for 8 seconds. Simultaneously, the computer will send a 0.004 second output pulse from D/A output pin #1 at t=0, 2, 4, and 6 seconds, for a total of 4 identical, evenly spaced pulses from pin 1 during the 8 second run. The spacing between the end of one output pulse and the start of the next output pulse is set to 1.996 second. Since each pulse is 0.004 second long, the separation between the start of one pulse and the start of the next pulse is 2.0 seconds. There will be a zero second lag before the start of the first pulse, in this example. The software and the four output channels are used to coordinate simultaneously during a single run of the program: 1) injections of reaction mixture by the wrap spring clutch syringe ram, 2) the opening and the closing of a 10-port, two position, pneumatically actuated valve (two channels), and 3) the pushes of an Harvard Instruments Model 22 syringe pump. Clearly other automation options are possible, for this type of software, as well.

The results of the push may be viewed on the computer screen corresponding to the readings of 8 input channels. The 12 bit A/D converter presents numbers which range from 0 to 4095, corresponding to −5 to +5 volts. It is possible to adjust the various inputs, and/or the ram position/linear potentiometer, and/or any amplifier gains or zero offsets, etc., to insure that the input readings are on scale. The data from an executed run is stored automatically as 8 ASCII files, one for each input channel.

Channel 1 is used to monitor the voltage input from the linear potentiometer 130, and thus the ram's position and motion. Channel 2 is used to record the voltage pulses from the photo interrupter 58 which monitors the rotational velocity of the flywheel 12. And these input channels all are sampled with reference to the computer's precise, known time base. Knowing the time period between when a voltage pulse is sent from the power supply 20 to the clutch's solenoid 134 (channel 0), and when the ram actually begins to push the tang 132 of the linear potentiometer 130 (channel 1), allows measurement of the response time of the wrap spring clutch and to thereby determine when reactions actually are initiated. The engagement time of the wrap spring clutch is equal to the sum of the response time of the solenoid plus the engagement time of the wrap spring clutch, itself (3 msec). Typically the engagement/response time of the solenoid plus wrap spring clutch is 12 msec, to a 4 msec, 44.2 Volt DC pulse.

It is a characteristic of the solenoid method of activation, together with the stop collar design, that the ram will push for a precise 25 msec, from only a 4 msec triggering electrical pulse (assuming a 2-stop collar at 1200 rpm). This is because the 4 msec triggering electrical pulse from the computer to the relay, and thus from the power supply to the solenoid, serves only to lift the pivot arm sufficiently to disengage the stop collar. Provided that the pivot arm is back down again before the next stop of the collar comes around, the clutch will rotate precisely ½ turn. One would think, therefore that at 1200 rpm, any pulse to the solenoid of duration less than 25 msec, say of 20 msec, would cause ½ rotation of the wrap-spring clutch, or similarly that a pulse of duration between 50 and 75 msec, would yield 3/2 rotation, etc. This assumption is not rigorously true, because the solenoid apparently either remains charged temporarily after each electrical pulse ends, or a finite period is necessary for return of the pivot arm to the collar, or both. Consequently, it has been found necessary to determine experimentally the optimal duration of the electrical triggering pulse needed for each desired distance of push by the ram. Fortunately, this optimization procedure is simple and quick to perform, by simply trying a few trial pulse duration settings in the edit menu, and observing, with for example the output reading of the linear potentiometer, how far the ram has moved.

FIGS. 7A-7E show views of the rear moving block 92, the brass front end piece 93, the threaded brass nut 90, and the brass locking pin 94. The purpose of the rear moving block assembly is to enable the sliding platform 42 to move forward, coupled precisely with the starting, stopping, and rotation of the lead screw when the locking pin is in place, and to enable reversal of the sliding platform 42 to its original position by manual rotation of the threaded brass nut 90 after one or multiple pushes of the ram, when the locking pin 94 is removed. The moving block 92 (FIG. 7A) is preferably fabricated from solid aluminum and has four precisely reamed through-holes. Its dimensions preferably are 8¼ inches wide ×1½ inches high ×1¼ inches deep. Centrally located at the top is a raised section 169 measuring ¼ inch high ×13/16 inch wide. The two axial holes 166 are spaced 7¾ inches apart, center-to-center, and each axial hole 166 accommodates a pressed fit sleeve roller bearing 96 through which the two ⅜ inch diameter hardened steel rails 40 of the slider pass. Sleeve bushings can be substituted for the sleeve roller bearings 96. An axial central hole 168 of 0.915 inch diameter accommodates with close tolerances the threaded brass nut 90, which rides along the acme lead screw 38. The top view of the moving block 92 displays a central vertical hole 170 of /3;4 inch diameter into which the removable brass locking pin 94 inserts with close tolerances.

The cylindrical threaded brass nut 90 (FIG. 7C) rides smoothly, without wobble along the stainless steel lead screw 38, and fits into the rear of hole 168 of the aluminum moving block 92. The brass nut's narrower portion of 0.915 inch diameter, passes completely through hole 168 of the moving block 92 with close tolerances. The front face 171 of the larger, 1.5 inch diameter rim of the threaded brass nut 90 contacts the rear of the moving block 92, and prevents the nut 90 from passing all the way through the block 92. The preferred measurement of nut 90 from front face 171 to the front edge 175 is 1¼ inches. When the nut 90 is properly in place, its front edge extends slightly beyond the front face of the moving block 92, such that the brass front end piece 93 may be attached tightly to the front face of the nut 90 two screws. The hole through the center of end piece 93 is of 9/16 inch internal diameter so that the ½ inch diameter lead screw 38 easily is able to pass through it. When the nut 90 is in the moving block and the front end piece 93 is rigidly attached with screws to the nut 90, the nut 90 is freely able to rotate along the acme lead screw 38, and within the moving block 92, even though all tolerances of the nut 90 and front end piece 93 in front of, behind, and within the moving block are close. The outer, ¼-inch-wide, outside edge 173 of the larger, ¼ inch×1.5 inch rear portion of the nut 90 is knurled (by example, and not by limitation), so that the nut 90 may be grasped with the fingers, and rotated easily while nut 90 is mounted within the moving block 92. When nut 90 is mounted properly in the moving block 92, and when the front end piece 93 is properly attached with screws to the front of nut 90, and when the entire system is assembled as in FIG. 1 except that the locking pin 94 is removed, and when the lead screw is prevented from rotating by the internal springs of the wrap spring clutch 34 due to the wrap spring clutch being disengaged, then manual rotation of the nut 90 causes the moving block, and the entire platform 42 to glide forward along the rails 40 when the nut 90 is screwed clockwise, or backwards along the rails 40 when the nut 90 is screwed counterclockwise (as viewed from the rear of the ram). The lead screw and nut in the constructed example are of right-handed thread, though left-handed thread could be used were the direction of the wrap spring clutch reversed from our present model. The outer diameter of front end piece 93 is 1⅛ inch, which is larger than the 0.915 inch diameter central axial hole 168 through the moving block. Thus the primary purpose of end piece 93 is to pull the moving block 92 backwards along with nut 90, when nut 90 manually is rotated counterclockwise. Front end piece 93 also may assist locking pin 94 in preventing further forward motion of the moving block 92 when rotation of the lead screw is stopped by the wrap spring clutch at the end of a push.

The removable brass locking pin 94 fits with close tolerances fully down into hole 170 in the top of the moving block 92, until the lower face 177 of the 1¼ inch diameter rim 179 of locking pin 94 touches the top of moving block 92. Though a snug fit, locking pin 94 easily can be inserted into or removed from its hole 170 in moving block 92, with the fingers. Both the cylindrical body 95 of locking pin 94, and the hole 170 into which locking pin 95 inserts, are ¾ inch in diameter. Machined in the center of the locking pin 94 at its bottom is a 0.2 inch long by ¼ inch diameter round extension pin 172 that fits with close tolerances into a corresponding hole 174 also of ¼ inch diameter drilled into the top center of threaded brass nut 90. To engage extension pin 172 with hole 174 of the brass nut 90, the removable locking pin 94 is inserted into hole 170 of the moving block 92, with the fingers simultaneously rotating the threaded brass nut 90 slowly within the moving block until the hole 174 and the pin 172 line up. Locking pin 94 then can be pressed fully into the moving block 92, and into hole 174 in nut 90; nut 90 will be locked into place, unable to move forward or backwards even slightly, or to rotate, within the moving block 92. Because the wrap spring clutch is unirotational, movement of the platform assembly 42 may only occur in a forward direction only if and when the lead screw 38 is turned counterclockwise by engagement of the wrap spring clutch with the rotating flywheel. A system employing a left-hand threaded lead screw and nut, with a clockwise wrap spring clutch would work equally as well.

The purpose of the removable locking pin 94 is to lock the nut 90 to the moving block 92 when pin 94 is in place, and to enable manual reversal of the moving block 92 and platform 42 to its original position after one or more pushes of the ram, when brass locking pin 94 is removed. Some provision for reversal of the pushing platform 42 and/or lead screw 38 is necessary because wrap spring clutches are unirotational and irreversible.

If the lead screw drive was omitted, and replaced with a revolving; snail-shell-like, sloping cam 260, as in FIGS. 15A-B and 16A-B, a mechanism for reversal of the cam would not be necessary. Instead the cam could be advanced by engagement of the wrap spring clutch until the cam lobe had rotated past its peak, or to an appropriate minimum, thereby enabling refilling of the syringes, and initiation of a new run. Additionally, were a manually removable locking pin 270 inserted through the cam, removal of the locking pin would enable uncoupling of the rotating cam from the unidirectional wrap spring clutch, to enable manual repositioning of the cam.

Figure 8A:
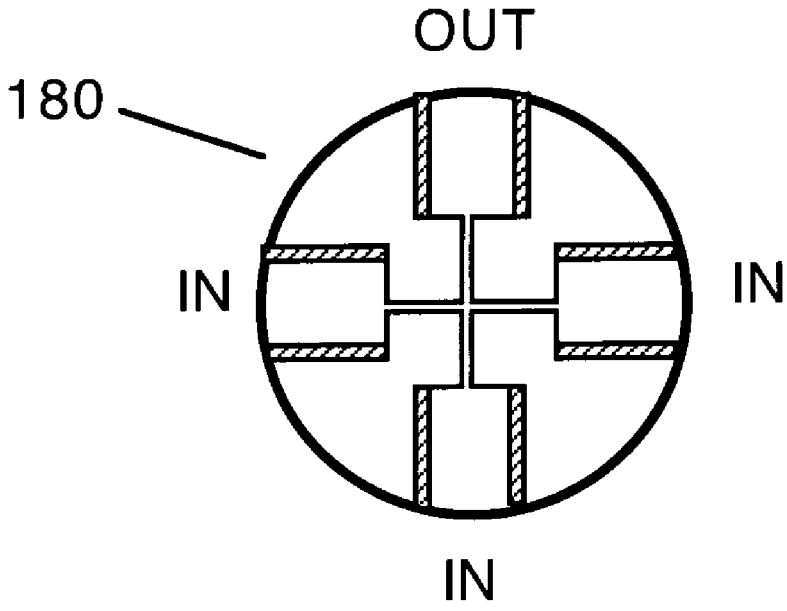
FIG. 8A is a cross sectional view of a "cross" mixer design of a wrap spring clutch syringe ram and frit mixer in accordance with the present invention.
Figure 8B:
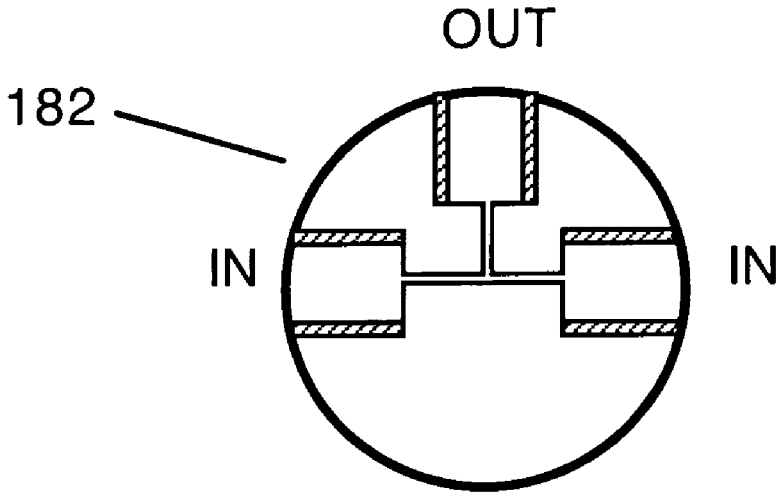
FIG. 8B is a cross sectional view of a "T" mixer design of a wrap spring clutch syringe ram and frit mixer in accordance with the present invention.
Figure 8C:
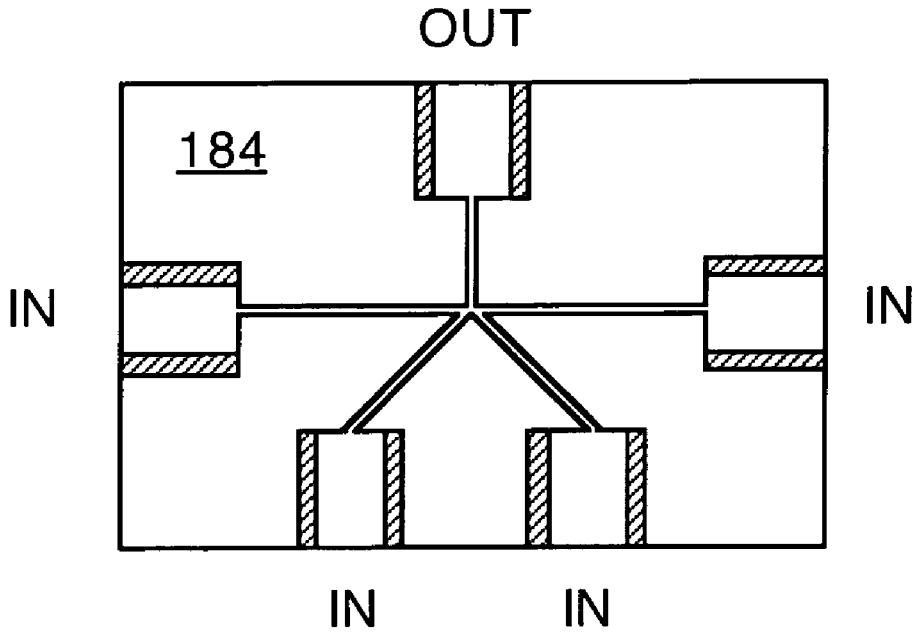
FIG. 8C is a cross sectional view of a "5-port" mixer design of a wrap spring clutch syringe ram and frit mixer in accordance with the present invention.
Figure 8D:
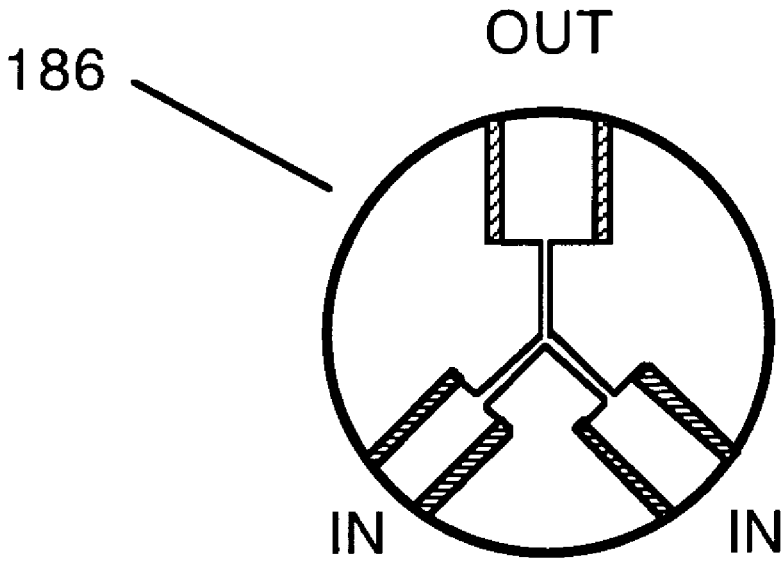
FIG. 8D is a cross sectinal view of a "T" mixer design of a wrap spring clutch syringe ram and frit mixer in accordance with the present invention.
Figure 8E:
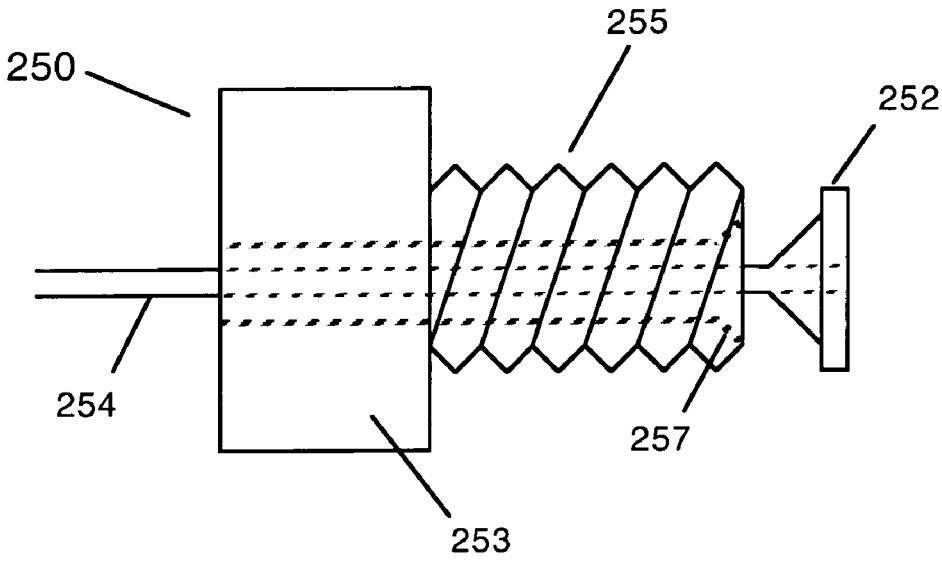
FIG. 8E is a side view of an Upchurch ¼"-28 low pressure fitting of a wrap spring clutch syringe ram and frit mixer in accordance with the present invention.

A plurality of mixing devices are shown in FIGS. 8A-8D. These mixers employ standard 14"-28 flat-bottomed, ⅜ inch deep, female fittings, which allow leak-tight connections to be made with commercially available ¼"-28 low pressure male fittings 250, available from Upchurch Scientific (FIG. 8E). The Upchurch male low-pressure fitting 250 consists of a plastic piece with a knurled portion 253 and a threaded portion 255. The knurled portion is ⅜ inch diameter 33 ⅜ inch long The threaded portion uses ¼"-28 threads and is ½ inch long. Through the center of the plastic piece is a hole through which the 1 1/16 inch tubing 254 passes. The through hole is flared at one end to accommodate the ferrule. The tubing 254 passes with close tolerances through a hole in the center of the ferrule 252. A ¼"-28 male plastic fitting has been employed which is manufactured by Valco Instruments, and which is similar to those fittings manufactured by Upchurch, except that it employs an additional collar bushing between the threaded piece and the ferrule. The internal tube diameters within the plurality of mixers of FIGS. 8A-8D range from 0.010 inch to 0.0135 inch. The external diameters of these mixers preferably are 1 inch. The mixer design types displayed are "Cross" 180, "T" 182, "Y" 186, and "5-port" 184.

Valco makes some "micro volume connectors" shaped as "T"'s, "Y"'s and "Crosses". These narrow-bore connectors use high-pressure ferrules and nuts manufactured by Valco that are not of the ¼"-28 design.

These connectors are composed of various materials, including stainless steel, and have a removable outer ring and a central insert. The removable outer ring contains the female threads which hold the male nut connector. Machined into the central insert are the narrow-bore through holes, and the seals for the ferrules. This ring/insert design enables the machinists at Valco to drill the insert with short holes as narrow as about 0.006 inch I.D. Additionally the "grid mixer" has been employed which is manufactured by Update Instruments (not shown). The grid mixer is essentially a "T" mixer, which uses a series of closely spaced, very fine mesh screens immediately downstream from the point of mixing, to generate turbulence. The introductory jets of the Update grid mixer are 0.008 inch I.D.

Figure 9A:
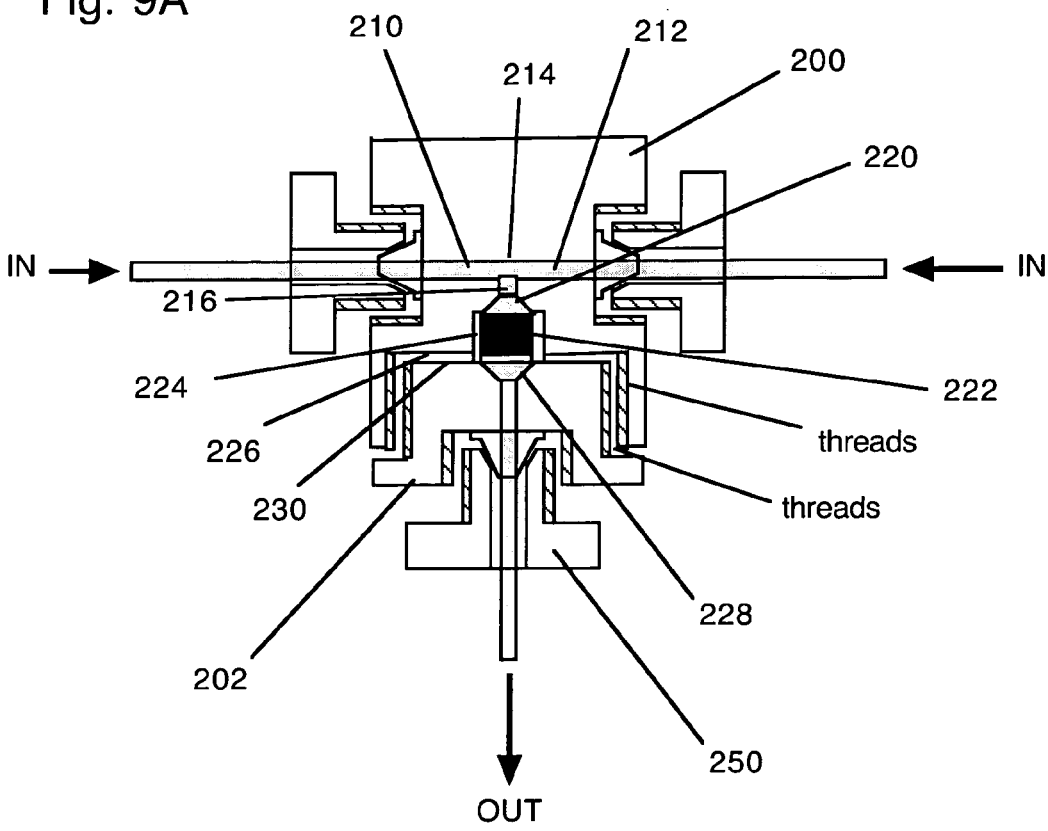
FIG. 9A is a cross sectional view of a first frit mixer of a wrap spring clutch syringe ram and frit mixer in accordance with the present invention.

With reference to FIG. 9A is a frit mixer which includes a female portion 200 and a male portion 202 which thread firmly together. The frit mixer is fabricated from Lucite plastic flat stock, as the Lucite round stock contains stress that leads to cracking, especially with ethanol. Flat bottomed, ¼"-28, machined female fittings are incorporated into the body of the mixer at the inlets and at the outlet, and we usually use male Upchurch low-pressure fittings and ferrules for leak-tight connections.

The frit mixer presently has two introductory jets 210, 212 each of 0.0135 inch I.D., though multiple jets, and jets of other diameters could also be employed. These jets 210, 212 meet at a "T" junction 214, and join into a single short tube 216, also of 0.0135 inch I.D. This very short tube 216 expands into an inverse cone 220. The purpose of the cone 220 is to minimize the internal volume of the mixer, while exposing a larger surface area on the face of the frit 222 to entering solvent. It has been found that in the absence of the cone 220, very high back pressures are experienced due to the impeded flow. The cone 220 is of minimal volume, and its angles are the same as the tip of a standard drill bit. The larger, open, base end of the cone 220 is of the same diameter as that of the entrance face of the frit (0.060 inch) The solution next flows out the base of the cone 220 and into the stainless steel frit 222.

The fused 316 stainless steel frit 222 is of 93 micron mean pore size (MPS) which is the largest pore size that could be located. Other pore sizes could also be used. The frit could be fabricated from materials other than sintered stainless steel such as PEEK. The preferable dimensions of the cylindrical frit 222 are 0.060 inch diameter by 0.080 inch long. Use of a shorter frit might be advisable as back pressures would be less, provided that mixing remained efficient. By weighing one of these frits, and from the knowledge that stainless steel has a density of 8 grams per cubic centimeter, the volume of air or solution contained in the frit mixer could be calculated. The volume of air would correspond to the so-called dead volume of the frit, though not necessarily to the mixing volume, which hopefully would be less. The total volume of the frit was 3.7 microliters, as calculated from its dimensions, and the weight was 0.010925 grams, to yield a density of 2.9474 grams per cc. Thus the fraction of stainless steel was 0.3694, and the fraction of air was 0.6306. From these numbers, the open volume within the frit can be calculated to be 2.34 microliters.

To prevent the solution from flowing around the sides of the frit 222, and to hold the frit 222 in place, the frit 222 is inserted tightly into a machined teflon tube 224, and this teflon sleeve 224 is pressed fit into a hole, 0.080 inch deep, drilled into the center of the bottom surface 226 of the female portion 200 (FIG. 9A). The frit 222, and its teflon sleeve are pressed fit into the female portion 200, such that the top of the frit 222 and the base of the cone 220 touch, and the top and sides of the teflon piece 224 simultaneously make a seal inside the body of the female portion 200. The teflon tube 224 is made slightly longer than the frit 222 is long, so that the teflon tube 224 extends slightly below the inner, lower face 226 of the body of the female portion 200.

Next, the male portion 202 of the mixer is screwed into the body of the female portion 200, such that the outlet cone 228 of male portion 202 is centered just below, and firmly against, the bottom outlet of the frit 222. With the male portion 202 in this position, the flat portion of the upper surface 230 of the male portion 202 presses tightly against the bottom of the teflon sleeve, thus making a water-tight seal around the frit, and between the male and female portions. Now solutions that enter through the inlet ports 210 and 212 of the female portion 200, will meet at the "T" junction 214, flow through the short tube 216, then through the cone 220, thence into and through the frit 222, out through cone 228, and to the outlet of the mixer. When female and male portions are fully assembled together, this frit mixer is preferably 1 inch in diameter by ⅞ inch high.

Highly efficient mixers with the smallest possible dead (mixing) volume are preferred, because mixing is more nearly instantaneous, and the moment of initiation of the reaction is better defined. Also, with a smaller volume mixer, shorter reaction times may be examined at a given flow rate.

Solutions of the reductant dithionite and the dark blue indicator dye indigo carmine have been used to test the efficiency of mixing of the frit mixer. Dithionite always was mixed in molar excess over the indigo carmine such that the reduction reaction of the blue dye was taken to clear. Flow rates varied from 0.0408 ml/sec to 0.816 ml/sec. A long, 0.022 inch I.D. nylon tube was attached to the outlet of the mixer. The experiment consisted of examining the relatively translucent nylon exit tube visually with a magnifying lens for blue color as the flow rate and reactant concentrations were varied.

At lower concentration ratios of dithionite to indigo carmine, during continuous flow at intermediate flow rates, the blue color was observed to extend into the outlet tube for several centimeters beyond the mixer before the blue color disappeared. When flow was stopped, the solution in the outlet tube beyond the mixer turned clear immediately. The slowest flow rates led to no blue color in the outlet tube, and increasingly faster flow rates led to the blue color extending correspondingly further down the outlet tube.

The observations raised the possibility that mixing actually had been efficient, but that the reaction simply was much slower than the mixing time, and also much slower than we thought it was. If it is true that mixing is fast, but the reaction is comparatively slow, then were the flow rate increased, the blue color would extend further down the outlet tube, as we observed. If mixing actually is always fast and efficient, the reaction will proceed at the same rate, and will take the same length of time to complete, regardless of the flow rate, at the same reactant concentrations. Thus, when the flow rate is made faster, the reacting mixture will travel further down the outlet tube, before the reaction reaches completion, and before the blue color completely disappears, just as we observed. To verify this possibility that mixing was efficient, but the reaction itself was rate-limiting, we decided to speed the reaction by increasing the concentration of dithionite. When the dithionite concentration was increased, the blue color did not extend as far down the outlet tube at the same flow rate. When the dithionite concentration was increased still further, no blue color was observed at the outlet of the mixer, even at the fastest, and even at the slowest, flows. This means that mixing was fast, and was completed probably within the mixer, itself, at all of the flows that we tested. Thus, our frit mixer works.

It was observed with a magnifying lens that the blue, indigo carmine solution and the clear dithionite solutions flowed side-by side, unmixed, beyond the mixing "T" junction 214, and through the tube 216 and cone 220, prior to entering the frit, suggesting that the majority of mixing was caused within the frit.

When designing mixers, others logically have attempted to introduce barriers to flow that would generate and/or initiate turbulence. The grid mixer of Update instruments is one example. Grids are known to generate turbulence, and therefore mixing, and this turbulence can be described theoretically. Another mixer that can be described theoretically, the Berger Ball mixer, introduces a spherical ball into the flowing stream, to generate turbulence downstream from the ball. A random pile of debris in the form of a porous stainless steel frit was placed in the path of the mixing solutions. It seemed that the random maze of narrow rivulets generated within the frit probably would initiate turbulence, as the randomly-placed rocks in a river generate rapids, and would complete the job of mixing the solutions that first began when the solutions first collided at the mixing "T" junction 214, even if it might be impossible to describe the random mixing within the frit mathematically. Such appears to be the case.

Figure 9B:
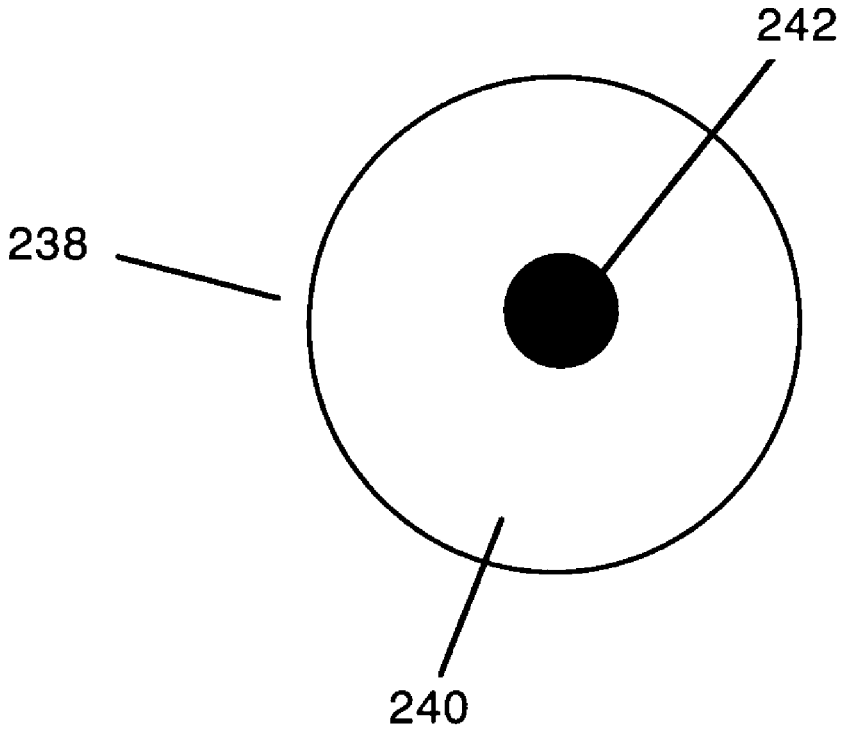
FIG. 9B is a cross sectional, frontal view of an Upchurch polymer-ringed frit of a wrap spring clutch syringe ram and frit mixer in accordance with the present invention.
Figure 9C:
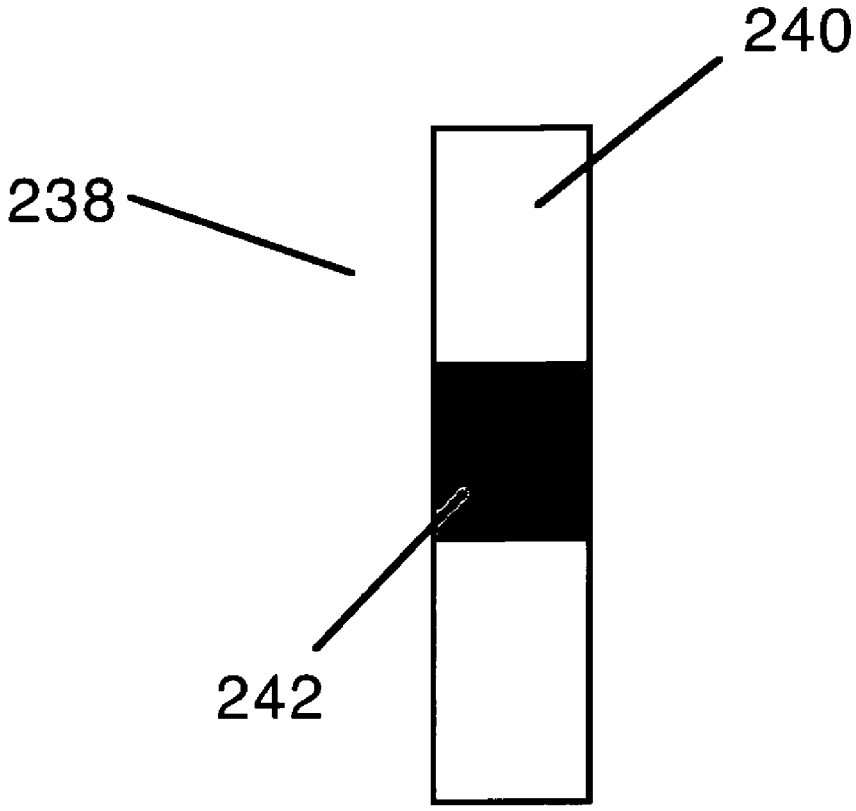
FIG. 9C is a cross sectional, side view of an Upchurch polymer-ringed frit of a wrap spring clutch syringe ram and frit mixer in accordance with the present invention.
Figure 9D:
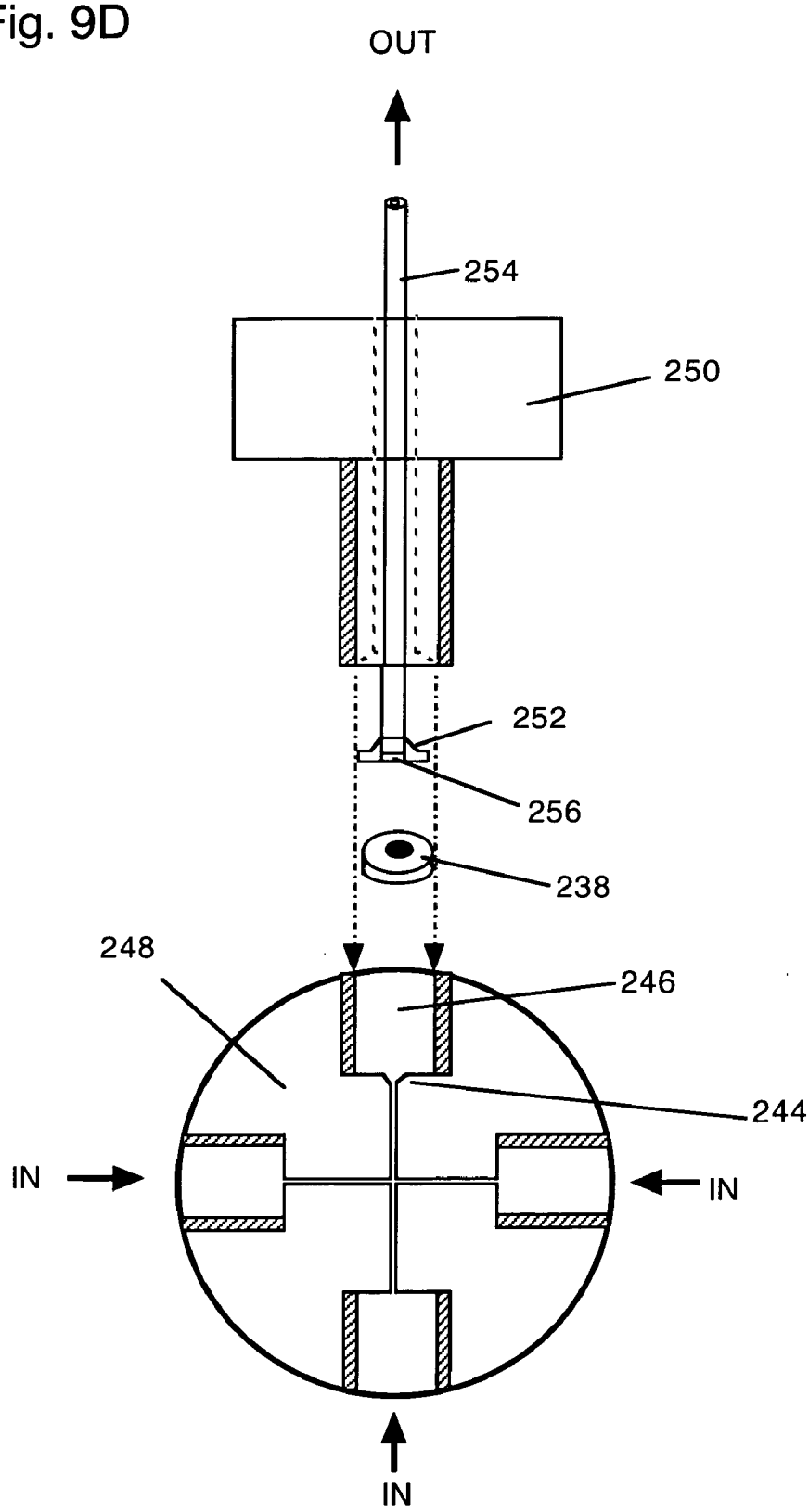
FIG. 9D is a cross sectional view of a second frit mixer of a wrap spring clutch syringe ram and frit mixer in accordance with the present invention.

Another, simpler route to constructing a frit mixer is to machine, or to purchase from Valco Instruments, a "T", "Y", "Cross", etc., and to obtain a frit from Upchurch Scientific. With reference to FIGS. 9B-9C, Upchurch markets frits of many different materials, including PEEK, ultra-high molecular weight polyethylene, titanium, and stainless steel. The advantage of the Upchurch frits 242 is that they may be obtained surrounded on their periphery with a polymer ring 240, to produce the Upchurch polymer-ringed frit 238. The frit 242, itself, is of dimensions 1/16 inch diameter, by 1/16 inch thick. The polymer rings 240 are ¼ inch diameter by 1/16 inch thick, and the frit 242 is held firmly in a 1/16 inch diameter through-hole in the center of the polymer ring 240. This polymer ring 240 serves the same purpose of making a seal around the sides of the frit, as does the teflon tube/sleeve 224 that surrounds the frit 222.

By inquiry from Upchurch, one can obtain frits with larger pore sizes, above 20 microns. Then, with reference to FIG. 9D, one drills a small cone 244 of maximal diameter 1/16 inch in the bottom well of the ¼"-28 female outlet hole 246 of a "T", "Y", or "Cross", etc., mixer 248 (FIGS. 8A-8D, FIG. 9D). Next, one simply inserts one of these Upchurch frits+polymer rings 238 into the slightly modified ¼"-28 female exit hole 246 of the mixer 248. The frit+polymer ring 238 is held in position in the female ¼"-28 well 246, by screwing a male, low-pressure Upchurch fitting 250 and ferrule 252 into the outlet hole 246. This male outlet fitting 250 and ferrule 252 also hold the reactor line 254. One pulls the 1/16th inch O.D. outlet reactor tube 254 back slightly in its ferrule 252, to make a "cone-like" exit space 256 immediately on the down-stream side of the frit 238, or alternatively carefully drills a small cone 256 into the tip of the 1/16 inch O.D., outlet reactor line 254, to enable solvent to exit the frit 238 and to pass more readily into the narrow-bore of the reactor tube 254. These simple-to-construct frit mixers work well, and probably mix significantly more quickly and efficiently than do the simpler "T", "Y", "Cross", etc., mixers which lack the frit, and which rely solely upon their narrow-bore jets to generate turbulence, and to effect mixing.

The wrap spring clutch syringe ram was tested by monitoring the pushing of the tang 132 of the linear potentiometer 130 and feed the output signal to one channel of the A/D converter 24 of the computer 18. The computer-triggered 0.004 second pulse from the power supply 20 to the solenoid 134 was simultaneously monitored on a separate channel. No data were collected on channels 0, 3, 4, or 5. Channel 1 was used to monitor 5000 points at 0.5 millisecond per point, from the computer-triggered signal from the 44.2 volt DC power supply to the solenoid of the wrap spring clutch. Channel 2 collected 5000 points at 0.5 millisecond per point, from the output of the linear potentiometer. Five, 4 millisecond pulses were sent by the computer from pin 1 of the D/A board to the solid-state relay which triggered the wrap spring clutch. The first pulse was sent after a 20 msec delay. The remaining four, 4 milisecond pulses were sent with a 0.096 second delay between the pulses. Thus a pulse was sent to the solenoid of the wrap spring clutch once every 0.100 second, following the initial 0.02 second delay.

For this first series of four replicate experiments, both the push platform 42 of the ram and the tang 132 of the linear potentiometer 130 always were moved back to their original starting positions prior to initiating the next run of the program. The rpm of the flywheel 12 was adjusted to 1200 rpm by adjusting the DC motor 14 with the speed controller 16 and the calibrated stroboscope. The program was run 4 times in succession, for a total of 20 pulses of the ram. After each run of 5 pulses by the program, the moving platform 42 and push block 95 and aluminum plate 98 assembly, and the tang 132 of the linear potentiometer 130 were returned to the same, original starting positions prior to another run of the program. The initial starting positions were verified by the voltage bit number reading of the linear potentiometer 130 on the computer screen. This reading was approximately 343 at the start of each run.

Figure 10:
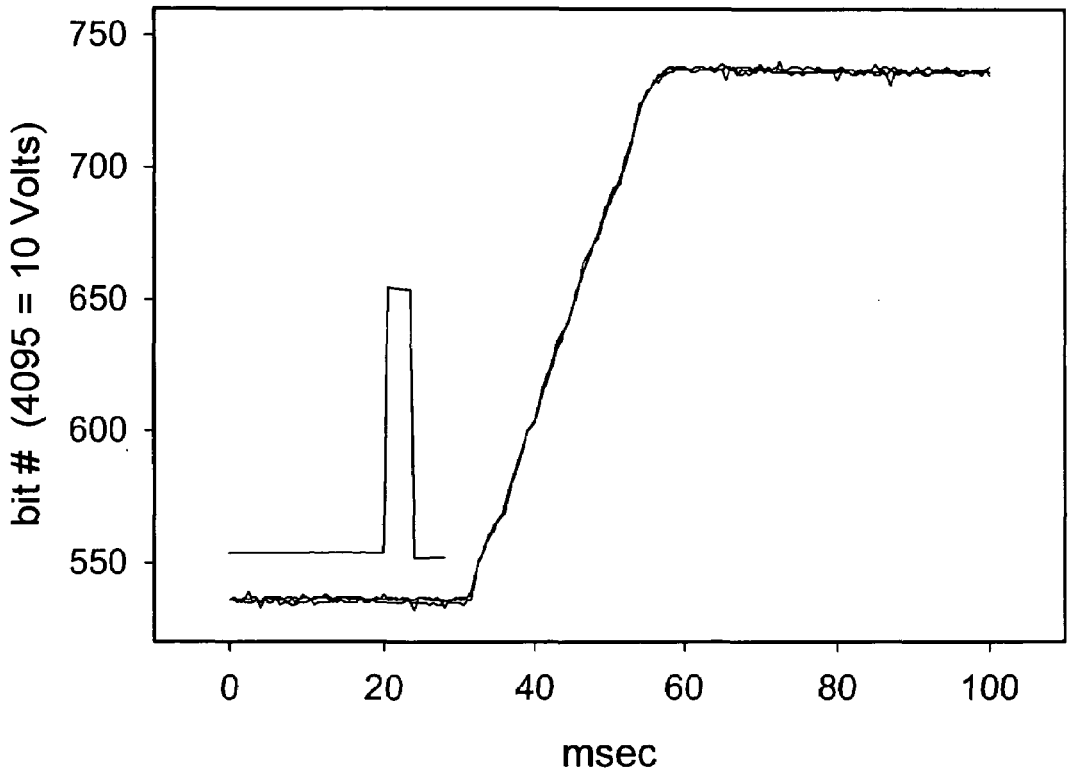
FIG. 10 is a graph of an output of a linear potentiometer obtained during three pushes of a wrap spring clutch syringe ram in accordance with the present invention.

FIG. 10 shows a graph of output traces of the linear potentiometer 130 from the second of the 5 pushes of the ram, from 3 of the 4 runs of the program. A computer-triggered, 4 msec pulse is also shown from the power supply 20 to the solenoid 134. The graph in FIG. 10 shows just how reproducible each push of the ram is. Please note that the clutch 34 engages fully 12 msec after initiation of the 4 msec computer pulse. Starting and stopping of the ram is very rapid, and may be nearly instantaneous on this time scale. Further, the rate of motion is constant and uniform during each push. The duration of each of the three pushes is measured in FIG. 10 with a ruler and is estimated to be 25.3 msec. The predicted time for ½ rotation of our flywheel at 1200 rpm is 25 msec (the two-stop wrap spring clutch engages for ½ turn). Note that interestingly, the output of the linear potentiometer 130 from each of these three pushes is exactly superimposible; even the noise during three separate pushes is invariable. Thus, each of the three runs is identical within the ability to measure it, with every push yielding the same, single line. In these experiments, pushes were performed reproducibly along the same sections of the ram, and simultaneously along the same segments of the linear potentiometer 130. The results are always identical for each push along the same ram/linear potentiometer segments.

Figure 11:
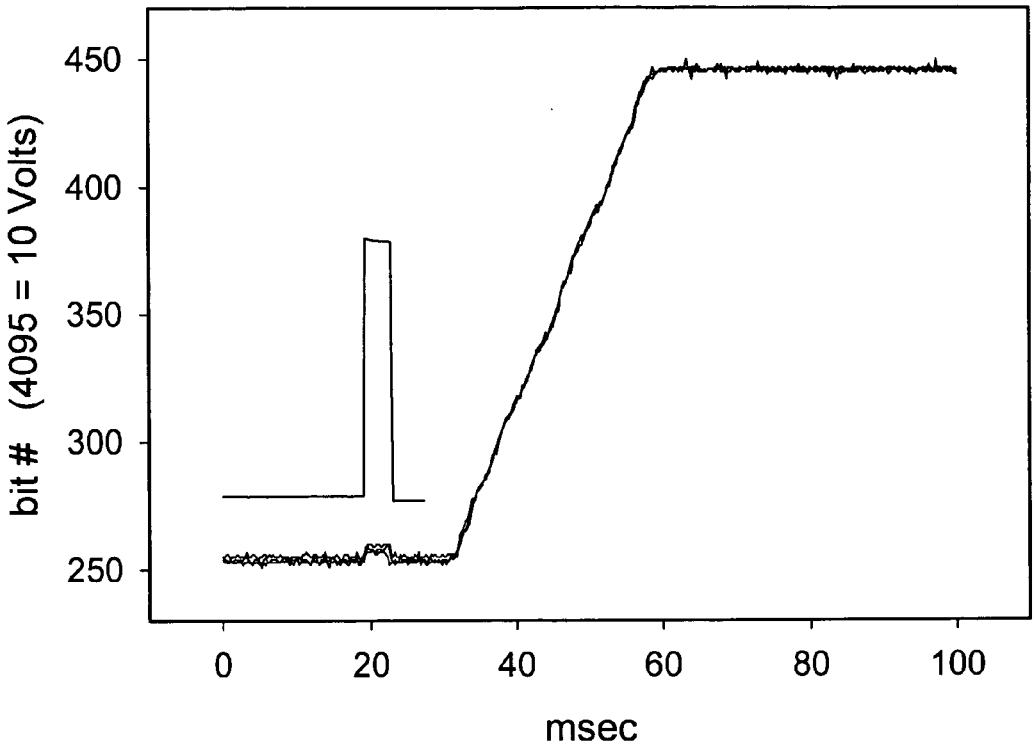
FIG. 11 is a graph of an output of a linear potentiometer obtained during three pushes of a wrap spring clutch syringe ram in accordance with the present invention.

A question then arises, as to whether the reproducible noise during a push is due to imperfections within the ram mechanism, say from perhaps an imperfect lead screw, or wobble of the platform, or slippage of the clutch, etc., or whether the reproducible noise is due to imperfections within the linear potentiometer. With reference to FIG. 11, the linear potentiometer 130 is pushed with a slightly different protocol. The ram was pushed only once, but the program was run six times in succession and did not reverse the push block between runs. Each time, between successive runs of the program, the ending/starting reading was recorded. At the end of the six pushes of the ram, the ram's moving platform 42 was not reversed to its initial starting position, but instead the platform 42 was left in its new, more forward position.

Next the mounting screws of the linear potentiometer were loosened, and the mounting position of the linear potentiometer 130 moved forward along the ram platform 42 and aluminum base 28 until the initial reading of 86 again was displayed by the potentiometer, with the tang 132 firmly against the aluminum plate 98 that is mounted on the front of the push block 95. The mounting screws which hold the linear potentiometer 130 to the aluminum base 28 were retightened. The program was run an additional 6 times in succession along this new, different segment of the ram, again the readings were recorded. The process of advancing the ram platform forward by 6 pulses, and of next moving the linear potentiometer forward to its original setting of 86, was repeated a total of 4 times. In this fashion, the same segments of the linear potentiometer were push repeatedly, while the ram platform and push blocks traversed along four different segments of the lead screw and slide.

FIG. 11 displays the results of the aforementioned test. The data is from three pushes along three different segments of the ram, but each push was along the same segment of the linear potentiometer 130. Notice again, that the wobble of the linear potentiometer's output during a push of the ram is essentially identical for each push. Thus, the noise is independent of the starting position of the ram, and results not from mechanical noise of the ram, but primarily is from the noise of that particular segment of the linear potentiometer. In other words, each push of our ram is so reproducible and quiet, that the ram is able to replicate the imperfections of the linear potentiometer reproducibly. The ram moves more precisely than the measuring equipment with which we are attempting to measure its precision of movement.

The purpose of the wrap spring clutch syringe ram is to push a syringe precisely, rapidly, and reproducibly, with virtually instantaneous starting and stopping, and with constant motion at a defined velocity during the intervening push. The wrap spring clutch additionally enables multiple, successive pushes, for which the duration of each push, as well as the interval before each successive push can be controlled precisely by a computer.

Three 0.5 ml pyrex, Hamilton "C"-type, gas-tight syringes 10 are mounted on the system, though any syringes could be used, provided that their barrels and/or plungers were not too flexible. Gas-tight Hamilton syringes use a teflon tipped plunger. A sample of the calculations which are used in determining the flows may be valuable. Hamilton gas-tight 0.5 ml. syringes have an internal bore diameter of 0.326 cm or 0.128 inch. The lead screw preferably has a pitch of 4.0 turns per cm, thus ½ turn of our lead screw advances the push platform ⅛ cm, or 0.125 cm. $\pi r^2 h = \pi \times (0.326/2)^2 \times (0.125) = 0.0104\ cm^3$. Thus each 0.5 ml Hamilton syringe delivers 10.4 microliters per ½ rotation advance of the lead screw and per ⅛ cm advance of the push platform.

The tubing 116, 122 is either stainless steel, nickel, or nylon, of dimensions 1/16 inch outside diameter (O.D.) and 0.020 inch internal diameter (I.D.). A volume of 10.4 microliters delivered from a syringe corresponds to $\{0.0104\}/\{\pi \times [(0.020 \times 2.54)/(2)]^2\} = 5.13$ cm of tubing. If the flywheel is rotating at 1200 rpm, then this rotational velocity corresponds to 1200/60=20 revolutions per second, so 1 revolution is 1/20=0.05 second, and ½ revolution is 0.025 second, or 25 msec. Therefore a push by the ram at 1200 rpm of a single 0.5 ml Hamilton gas-tight syringe ejects the solution from the syringe at a flow rate of 0.0104 ml/0.025 second=0.416 ml/second. Alternatively this flow rate may be defined in our 0.020 inch I.D. tubing as 5.13 cm/0.025 sec=205.2 cm/sec, or 2.052 meters/sec. Use of two 0.5 ml Hamilton syringes would double this flow rate to 0.832 ml/sec, and use of three 0.5 ml Hamilton syringes would triple this flow rate to 1.248 ml/sec. The flow from a single syringe of 0.416 ml/sec is laminar in our flow tubes. Laminar flow conditions exist when the Reynolds number is below about 2000, and turbulent flow conditions exist when the Reynolds number is above about 2000. It is considered best to maintain turbulent flow in reactor lines, and this turbulence can be achieved by flow rates above about 1 ml/second with our tube internal diameter of 0.020 inch, with water, at room temperature. Thus at the ram's pushing velocity of 0.125 cm/0.025 second=5 cm/second, at a flywheel rotational velocity of 1200 RPM, with a 4 turn per cm lead screw, use of three 0.5 ml syringes is necessary to achieve turbulent flow. Back pressures increase dramatically as flow rates increase. Unlike stepper motor systems, our wrap spring clutch syringe ram has the power needed to push against high back pressures, with apparent ease. Varying the speed of the flywheel, or the diameter of the syringes, or the pitch of the lead screw, or the diameter of the outlet tubing would vary the flow rates accordingly.

A 0.025 second squirt of a 10.4 microliter water droplet from the end of one of our 0.02 inch I.D. tubes can be observed relatively easily with the naked eye, provided that the observer does not blink at the inappropriate moment. It also is interesting to determine the acceleration and the deceleration of the moving platform 42 during a push, and to compare these values to the acceleration due to the earth's gravity. The final velocity of the ram is 5 cm/sec when the flywheel is rotating at 1200 rpm, and the lead screw has a pitch of 4 turns per centimeter. Since the wrap spring clutch accelerates the platform from rest to 5 cm/sec within 0.003 second, the acceleration is about 5/0.003=1666.67 $cm/sec^2$=16.6667 $meters/sec^2$. The acceleration due to gravity is 9.8 $meters/sec^2$. Therefore, the acceleration of the push block by the wrap spring clutch is 16.67/9.8=1.7×gravity. Since the push block stops within 1.5 msec, the deceleration of the push block by the wrap spring clutch is about 3.4×g.

Figure 12:
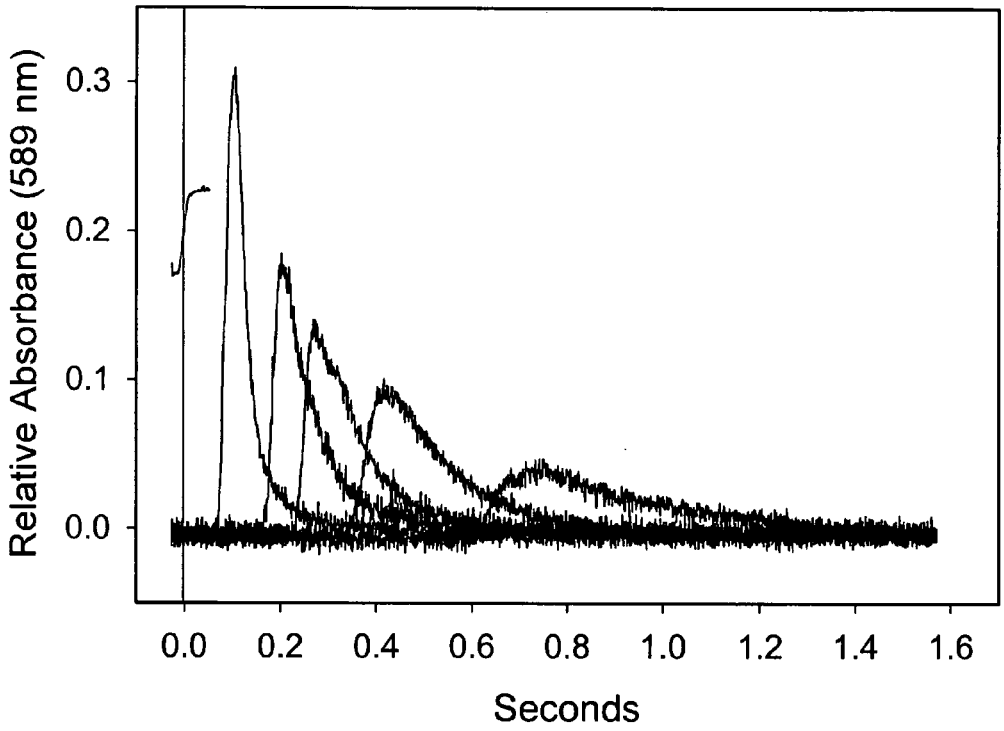
FIG. 12 is a graph of dispersion of 0.025 sec pulses of dye (bromophenol blue+$HCO_3^-$) during flow through reaction delay lines of variable lengths of a wrap spring clutch syringe ram in accordance with the present invention.

With reference to FIG. 12, the wrap-spring clutch syringe ram can be used to inject precise, reproducible 0.025 second, 10.4 microliter dye pulses into a continuously flowing carrier stream of water. This technique allows the study of characteristics of dilution and dispersion of dye pulses in flowing carrier streams. A single, 0.5 ml Hamilton syringe, mounted on the front of the wrap spring clutch syringe ram, was filled with dye solution and delivered the injection pulse. Please note that the dye pulses disperse appreciably at longer and longer distances of flow. Flowing reactor systems frequently are used in biochemistry for the study of biochemical reactions, and this dispersion due to flow affects reactions. The injection pulses from the single syringe, and the carrier solution each flowed at the same rate of about 0.42 ml/second in these experiments. Thus during the brief, 0.025 second injection pulses, the combined flow rate in the outlet tube was about 0.84 ml/second. These flow rates yielded laminar flow in our 0.020 inch internal diameter tubes.

The wrap-spring clutch syringe ram also has been used to inject pulses of water containing various dissolved gases into a flowing carrier stream, and to monitor the gases present in the injected pulse with a mass spectrometer equipped with a flow-through membrane inlet. FIG. 13 shows the output traces obtained by the A/D—D/A computer set-up that was described for pulsing and monitoring the wrap spring clutch syringe ram. However, in this experiment, three of the previously unused input channels are employed to monitor the output from the amplifiers of each of three collectors of an MAT 250 isotope ratio mass spectrometer. The collectors are positioned for mass/charge (m/z) ratios of 2, 28, and 30, and are monitoring the gases $H_2$, $N_2$, and $C_2H_6$ simultaneously from the same injection pulse. The gases are detected by the mass spectrometer at different times, due to their different diffusion rates across the semipermeable, thin, silicone membrane of the inlet. Hydrogen gas apparently diffuses most rapidly across the membrane, and ethane most slowly; diffusion rates probably are related, in part, to the sizes of the molecules. Note that there is appreciable temporal spreading of the initial 0.025 second injection pulse of the wrap spring clutch syringe ram, due to dispersive laminar flow in the carrier stream along the 1.7 second-long tube, plus dispersion as the gases cross the silicone membrane prior to their entry into the mass spectrometer.

Figure 14:
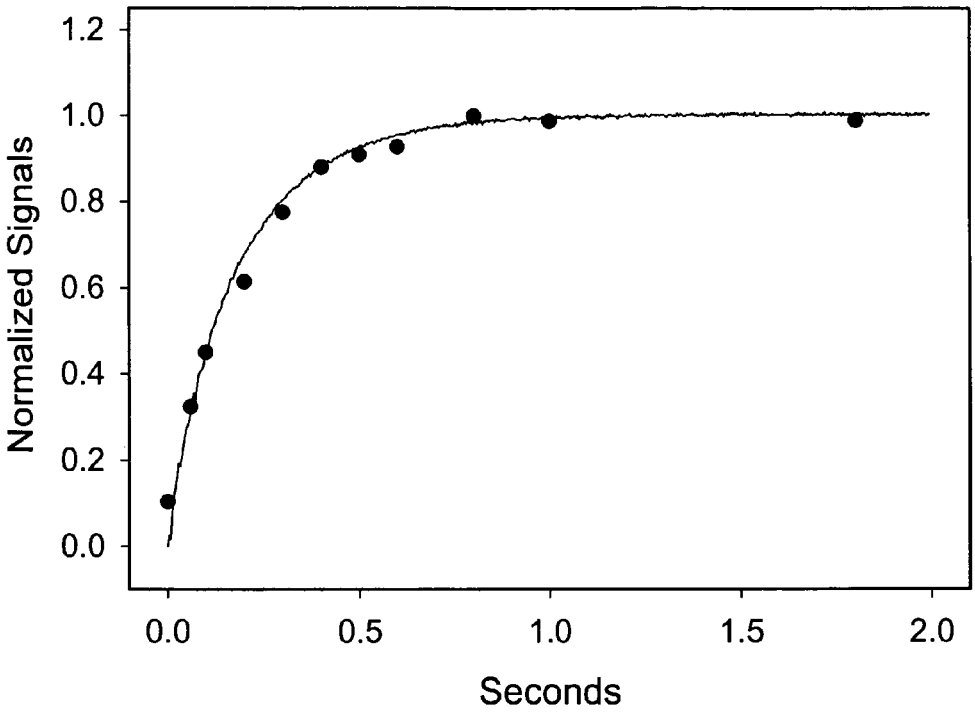
FIG. 14 is a graph which compares progress curves for the reaction of $HCO_3^-+H^+=CO_2+H_2O$ of a wrap spring clutch syringe ram in accordance with the present invention.

The wrap spring clutch syringe ram also has been used to monitor the enzyme-catalyzed conversion of bicarbonate to carbon dioxide by bovine carbonic anhydrase II with pulsed-injection membrane inlet mass spectrometry. The dots in FIG. 14 were obtained with the membrane inlet mass spectrometer when reactions were initiated by pulsed injection of reagents with the wrap-spring clutch syringe ram, and the mixed reactants were incubated for different periods of reaction by the push-pause-push method. The continuous trace of FIG. 14 was obtained with the same reactants when they were mixed and the reaction was observed by stopped-flow spectrophotometry with a commercially obtained OLIS stopped-flow apparatus coupled to a Cary 14 spectrophotometer. That the dots and the line are superimposible suggests that both the mass spectral method with our wrap spring clutch syringe ram, and the widely accepted kinetic technique of stopped-flow spectrophotometry, yield the same progress curve.

Figure 15A:
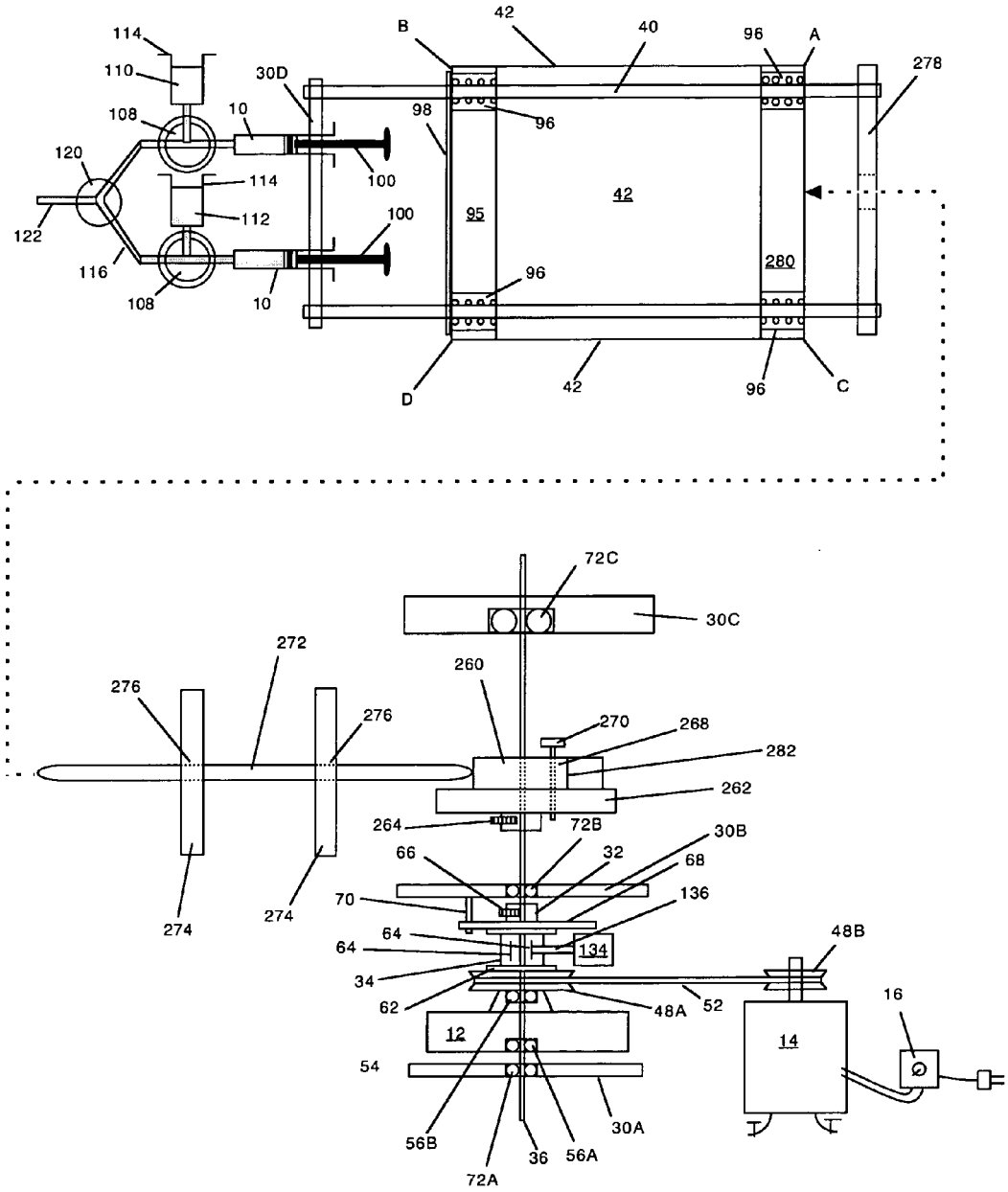
FIG. 15A is a top view of a cam wrap spring clutch syringe ram in accordance with the present invention.
Figure 15B:
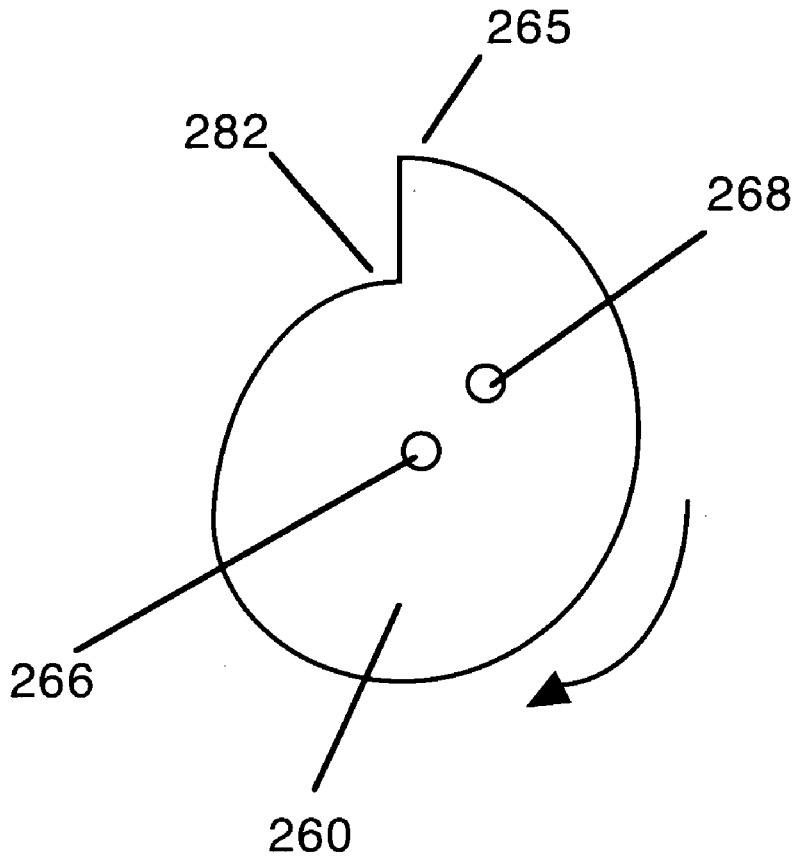
FIG. 15B is a top view of a rotating cam of a wrap spring clutch syringe ram in accordance with the present invention.

FIGS. 15A and 15B show an additional design of wrap spring clutch syringe ram, in which the lead screw is replaced by a cam 260, and in which a multiple stop collar 64 is used on the wrap spring clutch 34 (the stop collar is, itself, a cam). The wrap spring clutch is included between the flywheel pulley 48A and the rotating turntable 262. It should be clear that the same components and design between the motor 14 and the base support 30B are used as in FIG. 1. However, in the cam design of FIG. 15A, once the shaft 36 extends forward of base support 30B, the lead screw 38 is omitted. In place of the lead screw 38, a rotating table 262 is affixed to the shaft 36 by an Allen screw 264. When the wrap spring clutch is engaged, the shaft 36 rotates, and the table 262 also rotates. In front of, or resting upon, table 262 is the cam 260. The cam has at least one lobe 265, and a central bushing or bearing 266, through which shaft 36 passes with close tolerances. In this design, the cam has a peripheral hole 268 for insertion of a removable pin 270, again with close tolerances. Pin 270 is inserted through hole 268 of cam 260, and extends with close tolerances into a corresponding hole in table 262. The removable pin 270 thus is similar in function to the removable brass locking pin 94 of the rear moving block of FIG. 1 and FIG. 7E, in that when inserted, pin 270 locks the cam 260 in relation to the rotating table 262, so that the cam 260 and table 262 start and stop rotating as a single unit. When pin 270 is removed, the cam 260 can be rotated and repositioned in relation to the table 262. If the table has a number of holes drilled into it, with each hole at the same radius from the center as the radius of hole 268 is from the center of the cam 260, then the cam 260 can be rotated and locked by insertion of pin 270 in as many different orientations to the table 262 as there are holes. Removable pin 270, also could be a threaded machine screw, and the radial holes in table 262 also could be tapped. A threaded connection between cam 260 and table 262 would enable shaft 36 to be horizontal, rather than only vertical, during use of the syringe ram. Table 262 and cam 260 preferably should be made of light-weight materials, and be of minimal thickness and of minimal diameter, to keep their combined rotational inertia within the capabilities of the wrap spring clutch.

The turntable 262 rotates only when the wrap spring clutch 34 is engaged, which allows pin 270 to remain permanently inserted between the turntable 262 and the cam 260. Alternatively, the pin 270 may be regarded as a permanently engaged clutch which links rotation of the turntable 262 continuously with rotation of the cam 260.

A cam follower 272 is pushed by the cam 260, as the cam 260 is rotated by the flywheel 12 during engagement of the wrap spring clutch 34. The cam follower 272 is guided by two cam follower supports 274 through close tolerance sleeve bushings 276 or sleeve bearings 276. The forward end of the cam follower 272 passes through a hole of the rear support 278 of the slide, and contacts, or is attached perhaps via a threaded or a permanent connection, to the rear moving block 280 of the pushing platform 42. This moving slide platform 42 is similar to that of FIG. 1, except that the rear moving block 280 is not identical to the rear moving block of FIG. 7. Rear moving block 280 lacks central holes 168 and 170, and contains no threaded nut 90, no removable locking pin 94, and no brass front end piece 93.

The motor 14 turns the flywheel 12 via the pulleys 48B and 48A and the v-belt 52. When the wrap spring clutch is engaged, the energy of flywheel 12 turns shaft 36, which turns the rotating table 262. When pin 270 is in place, the cam 260 rotates and pushes the cam follower 272. The cam follower pushes rear moving block 280, and thereby pushes the pushing platform 42, with push block 95 and front plate 98. Front pushing plate 98 pushes the plungers 100 of the syringes 10.

The wrap spring clutch is irreversible and unidirectional. An interesting advantage of the rotating cam design as compared to the rotating lead screw design, is that it no longer is necessary with the cam design to employ a removable pin 94 to allow retraction of the push platform 42, and refilling of the syringes. Rather, one can engage the wrap spring clutch repeatedly to advance the cam forward beyond the cam's highest lobe 265, until a minimum 282 on the cam 260 is again available to the cam follower 272. Then one can fully retract the cam follower 272, push platform 42, and syringe plungers 100 manually, until the rear of the cam follower again contacts the cam. Inclusion of the turntable 262 and removable locking pin 270 allows an additional method of repositioning of the cam lobe 265 in relation to the turntable 262 and cam follower 272. However, were the turntable 272 and locking pin 270 omitted from the design, and the cam 260 fixed directly onto the shaft 36 with a set screw, mechanical rotation of the cam 260, and both mechanical advancement and manual retraction of the cam follower 272 and slide platform 42 could be achieved simply by advancing the cam 260 incrementally to the appropriate position by repeated engagement of the multiple-stop wrap spring clutch 34.

When a wrap spring clutch is fitted with a multiple-stop collar, the wrap spring clutch can rotate the cam, and push the syringe plungers, incrementally, in as many increments of a full circle or of a full displacement, as there are stops on the stop collar. For example, when fitted with a one-stop collar, a wrap spring clutch would rotate the cam a minimum of one full revolution per engagement, and a 4-stop collar would rotate the cam a minimum of 90 degrees, each time a momentary electrical pulse were delivered to the solenoid. With the 1-stop collar, the syringe would be displaced to the full extent of the cam on one engagement of the clutch. With a 4-stop collar, the syringes could be displaced at minimum ¼ the displacement of the cam, per engagement of the wrap spring clutch. The velocity of each push could be varied by varying the velocity of the flywheel by varying the speed of the electric motor, or by varying the ratio of the pulleys between the electric motor and the flywheel.

Figure 16A:
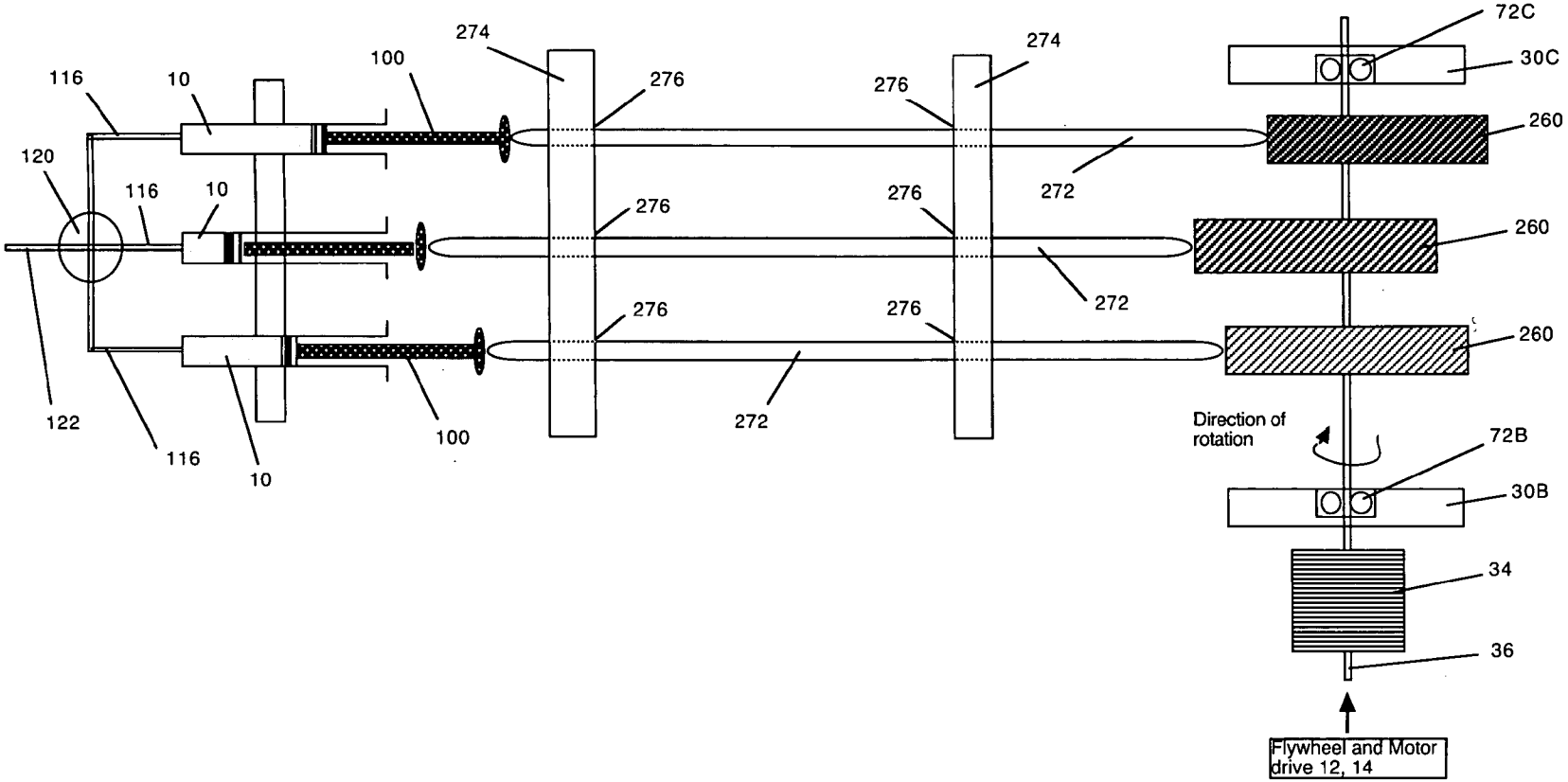
FIG. 16A is a top view of at least one syringe actuated by the rotation of a cam of a wrap spring clutch syringe ram in accordance with the present invention.

With reference to FIG. 16A, a rotating camshaft containing multiple cams could be employed with the relative angle of the lobe of each cam being adjustable relative to the other cams. Further, were each cam to push a separate cam follower, this arrangement would yield the possibility of pushing any of several syringes, each syringe mounted on the front of a separate slide, so that each syringe could be pushed at a specified time. Thus a slide of FIG. 15A could be omitted, and a syringe plunger could be pushed directly by the cam follower 272, itself, as in FIG. 16A.

Figure 16B:
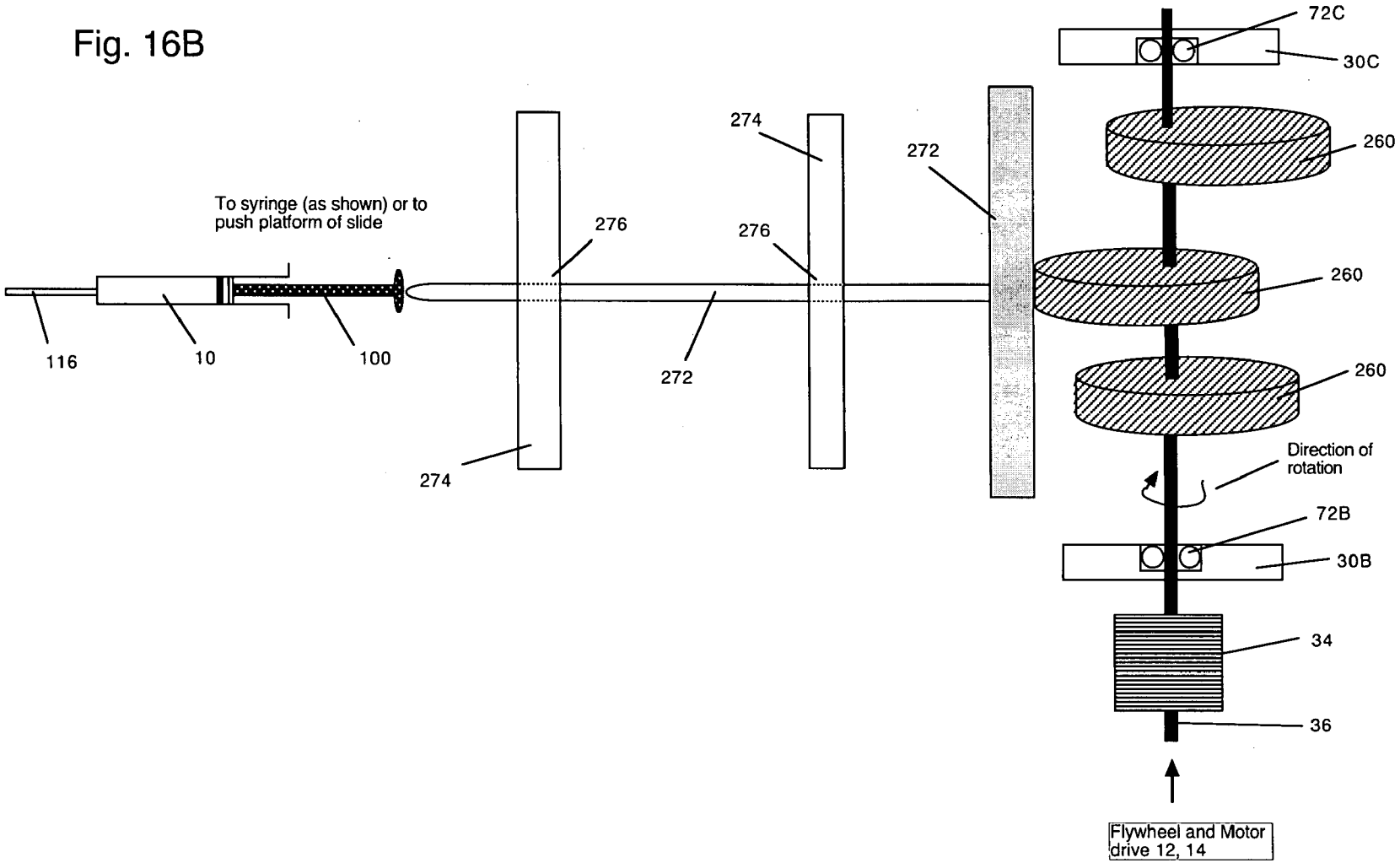
FIG. 16B shows a top view of a wrap spring clutch syringe ram with multiple cams with the lobes oriented radially in different directions and mounted on a single camshaft of a wrap spring clutch syringe ram in accordance with the present invention.

FIG. 16A shows a top view of a wrap spring clutch syringe ram with multiple cams 260 mounted on a single camshaft, with each cam 260 pushing a separate cam follower 272, and with each cam follower 272 pushing a separate syringe plunger 100. The cam lobes can be oriented radially outward in different preselected directions, and the cams can be of different slopes, to yield different rates and sequences of pushing of the syringes. FIG. 16B shows a top view of a wrap spring clutch syringe ram with multiple cams 260 with their lobes oriented radially in different directions and mounted on a single camshaft 36. By this design, each cam pushes the same cam follower 272. Both designs enable the push-pause-push technique to be performed.

The disadvantages of the cam design are two. First, if the cam rotates beyond its lobe 265 to a minimum 282, there no longer is any mechanical restraint behind the cam follower and the push platform to prevent a high back pressure in the syringes from reversing the ram. Second, when there is little back pressure or friction in the syringes, there is little to prevent the slide from continuing to advance on its own momentum, after the wrap spring clutch first has accelerated the platform to speed, and then has stopped rotation of the cam. Thus, though the braking action of the wrap spring clutch will stop the rotation of the cam quickly, the cam follower 272 and pushing platform 42 might continue to advance forward on their own momentum after the cam has stopped pushing. These two disadvantages of the cam design are not problems for the lead screw design (FIG. 1), in which the push platform 42, nut 90, lead screw 38, and wrap spring clutch 34 are tightly coupled, both fore and aft. With the lead screw design, the nearly instantaneous accelerating and braking properties of the wrap spring clutch, and also the wrap spring clutch's ability to hold firmly against a load in both the forward and reverse directions are utilized where needed, on the syringe ram platform 42, itself.

It is assumed even with the screw-driven system that back pressure in the syringes, or the friction of the plungers 100 in the syringe barrels 10, is sufficient to prevent further advance of the plungers 100 on their own momentum after the ram has stopped. However, the rear tips of the syringe plungers 100 can be threaded and screwed into threaded holes in the push plate 98, to make a tightly coupled system. The only apparent drawback of the lead screw design compared with the cam design is that with the lead screw design some means must be available to enable decoupling of the push platform from the irreversible, unidirectional wrap spring clutch, to enable retraction of the push platform, and refilling of the syringes. The removable locking pin/manually reversible nut assembly is both simple and effective, and is one of several possible solutions to this difficulty.

Rapid-reaction rams can be used for at least three types of kinetic techniques. These include stopped-flow, continuous-flow, and push-pause-push. Stopped-flow studies require a ram that can push two reactant solutions together rapidly, and then stop their flow instantly. Usually, stopped-flow uses pressurized gas and a piston to push syringes, and a stop syringe to stop the flow. Observation of the mixed solutions occurs through an observation cell located immediately downstream from the point of mixing, and observation is begun at the moment when flow stops. The wrap spring clutch syringe ram, because it can accelerate and decelerate so quickly, should be very effective for the stopped-flow technique. Because stopped-flow apparatuses presently use both gas-driven pistons, and stop syringes, the pressures generated in the reaction solution can be quite high, and pressures may generate artifacts and/or affect reactions. For example, pressure-generated spikes have been generated when working with pH indicators with gas-driven stopped-flow machines. Use of a wrap spring clutch syringe ram should avoid these pressure anomalies, especially since no stop syringe is necessary. On the other hand, the wrap spring clutch syringe ram can start and stop the flow of solutions so quickly that effects due to water hammer may arise.

In the continuous-flow method, solutions are mixed by the ram in the usual way, usually using two syringes and a mixing chamber. The reacting mixture then is flowed from the mixer into a reactor tube to achieve time resolution. There are two continuous-flow methods of achieving this time resolution, and both are based upon the premise that the duration of the reaction is equal to the length (volume) of the tube, divided by the flow rate. In the first method, reaction times are varied by flowing the reactant mixture at a constant pumping speed, but through several different tubes of varying lengths (volumes). In the second method, a single reactor tube is used, and reaction times are varied by varying the pumping speed. When driven by an AC motor, or by a DC motor adjusted to a constant speed, our wrap spring clutch syringe ram can pump at a constant velocity as is required for the first continuous-flow method. Or the wrap spring clutch syringe ram can pump at any desired velocity, by using a DC motor with a variable speed control, or a stepper motor at variable speeds, thereby enabling the second method of continuous flow. Thus continuous-flow kinetics by either of the commonly used continuous-flow methods are simple and straight forward for the wrap spring clutch syringe ram.

The push-pause-push method is a variant of the continuous flow technique. In this method a single reactor line of constant length is used. The syringes are pushed at a constant velocity by the ram, and the mixed reactants are flowed rapidly into the delay line. However, before the reactants reach the detector, flow is instantly paused. The reactants then are allowed to incubate, or to age, in the reactor line during the pause, as the solution remains stationary in the line. After a predetermined pause time, flow immediately is reinitiated, and the reactants then are expelled from the reactor line for collection, or into or through a detector, by this second push, usually by the same ram. Although the pumping speeds of the two pushes can be varied, the pumping speed usually is held constant and normally is of the same velocity during both pushes. Different reaction times normally are obtained by varying the duration of the pause. The age of the solution is the sum of the two flow times necessary for the solution to traverse from the mixer to the detector, plus the pause time. Because the wrap spring clutch syringe ram is able to start and to stop almost instantly, and to flow at a defined rate during the push, and because successive pushes are easily performed after a programmable pause of any desired length, the wrap spring clutch is well suited for performing the push-pause-push technique.

A seldom-used variant of the continuous flow technique is to vary the pushing velocity of the ram continuously as the reactants flow through a constant length reactor line to the detector. The wrap-spring clutch syringe ram can be used for this technique, provided that the ram is fitted with a DC motor, or a stepper motor, and the speed control is programmed to ramp the velocity of the motor/lead screw/push block continuously over a range of known pumping speeds, with the clutch continuously engaged.

Rapid-reaction rams that use low inertial DC motors or stepper motors rarely are used in stopped-flow spectrophotometry, but frequently are employed in rapid-reaction studies, for both continuous-flow and push-pause-push experimental designs. The wrap-spring clutch syringe ram, due to its relatively inexpensive cost, its nearly instantaneous starting and stopping, and its constant velocity of push, is particularly well suited to push-pause-push, and continuous-flow systems. Additionally, the wrap spring clutch syringe ram may be preferred over the gas-driven pistons of present stopped-flow equipment because rapid flow rates can be obtained with the wrap spring clutch syringe ram, and no stop syringe is necessary; pressure aberrations and artifacts might be avoided by our improved design. Thus, the wrap spring clutch syringe ram is adaptable, and should excel, when applied to any of the kinetic flow methods that we know of.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A wrap spring clutch syringe ram comprising:

a motor;

a flywheel being driven by said motor;

a slide platform being driven linearly by rotation of a lead screw;

at least one syringe, a plunger of each said at least one syringe being pushed by said slide platform; and a wrap spring clutch engaging and thereby coupling the rotation of said flywheel with said lead screw to drive said slide platform, said wrap spring clutch being actuated by a solenoid, said flywheel having a substantial mass, said substantial mass providing rotational stability when said lead screw is coupled to said motor, said wrap spring clutch disengaging and thereby decoupling said flywheel from said lead screw, said wrap spring clutch initiating rotation of said lead screw.

2. The wrap spring clutch syringe ram of claim 1, further comprising:

an electric power source supplying electrical power to said solenoid.

3. The wrap spring clutch syringe ram of claim 2, further comprising:

a switch being disposed between said electric power source and said solenoid, said switch controlling the actuation of said solenoid.

4. The wrap spring clutch syringe ram of claim 3, further comprising:

a computer controlling the actuation of said switch.

5. The wrap spring clutch syringe ram of claim 4, further comprising:

a potentiometer having a moveable tang which changes the resistance thereof, said potentiometer being mounted adjacent to said slide platform, said slide platform moving said moveable tang as said slide platform is moving forward, said potentiometer being connected to said computer through an A/D converter, the electrical output of said potentiometer indicating the position of said slide platform.

6. The wrap spring clutch syringe ram of claim 2, further comprising:

a movable safety limit switch mounted adjacent to said slide platform, to disconnect said electrical power of said electric power source from said solenoid, when said slide platform advances forward sufficiently to trip said safety limit switch.

7. The wrap spring clutch syringe ram of claim 1, further comprising:

a mixer receiving the an output of said at least one syringe.

8. The wrap spring clutch syringe ram of claim 7, further comprising:

said mixer being a frit mixer, a porous frit being inserted into said frit mixer.

9. The wrap spring clutch syringe ram of claim 8, further comprising:

an entrance to said porous frit of said frit mixer being flared to provide improved flow from said at least one syringe; and an exit from said porous frit of said frit mixer being flared to provide improved flow from said frit mixer.

10. The wrap spring clutch syringe ram of claim 7, further comprising:

a reactor to receive an output of said mixer.

11. The wrap spring clutch syringe ram of claim 1, further comprising:

a speed control to enable adjustment of the rotational velocity of said motor.

12. The wrap spring clutch syringe ram of claim 11, further comprising:

a feedback control to enable maintenance of the rotational velocity of said motor.

13. The wrap spring clutch syringe ram of claim 1, further comprising:

a moving block being slidably attached to said slide platform;

a nut being structured to threadably receive said lead screw, said nut being rotatably attached to said moving block, a block hole being formed through a top of said moving block and a nut hole being formed through at least one wall of said nut; and a pin being inserted through said block and nut holes to move said slide platform in a forward direction, said pin being removed to move said slide platform backward.

14. The wrap spring clutch syringe ram of claim 1 further comprising:

a reactor to receive an output of said at least one syringe.

15. The wrap spring clutch syringe ram of claim 1, further comprising:

a tachometer being used to monitor the velocity of rotation of said flywheel, said motor, or said lead screw.

16. A wrap spring clutch syringe ram comprising:

a motor;

a camshaft having at least one cam lobe;

at least one cam follower being in contact with said at least one cam lobe;

a flywheel being driven by said motor;

at least one syringe, a plunger of each said at least one syringe being driven linearly by said at least one cam follower; and a wrap spring clutch engaging and thereby coupling the rotation of said flywheel with said cam shaft, said wrap spring clutch being actuated by a solenoid, said flywheel having a substantial mass, said substantial mass providing rotational stability when said cam shaft is coupled to said motor, said wrap spring clutch disengaging and thereby decoupling said flywheel from said cam shaft, said wrap spring clutch initiating rotation from said cam shaft.

17. The wrap spring clutch syringe ram of claim 16, further comprising:

a support for restraining a barrel of each of said at least one syringe from movement.

18. The wrap spring clutch syringe ram of claim 16, further comprising:

a means for decoupling said wrap spring clutch from said cam shaft to rotate said cam shaft.

19. The wrap spring clutch syringe ram of claim 16, further comprising:

a means to coordinate engagement, disengagement and braking of said wrap spring clutch.

20. The wrap spring clutch syringe ram of claim 1, further comprising:

a support for restraining a barrel of each of said at least one syringe from movement.

21. The wrap spring clutch syringe ram of claim 1, further comprising:

a means for decoupling said wrap spring clutch from said lead screw to rotate said lead screw.

22. The wrap spring clutch syringe ram of claim 1, further comprising:

a means for decoupling said lead screw from said slide platform to move said slide platform.

23. The wrap spring clutch syringe ram of claim 1, further comprising:

a means to coordinate engagement, disengagement and braking of said wrap spring clutch.

24. A wrap spring clutch syringe ram comprising:

a motor;

a camshaft having at least one cam lobe;

at least one cam follower being in contact with said at least one cam lobe;

a slide platform being driven linearly by said at least one cam follower;

a flywheel being driven by said motor;

at least one syringe, a plunger of each said at least one syringe being pushed by said slide platform; and a wrap spring clutch engaging and thereby coupling the rotation of said flywheel with said cam shaft, said wrap spring clutch being actuated by a solenoid, said flywheel having a substantial mass, said substantial mass providing rotational stability when said cam shaft is coupled to said motor, said wrap spring clutch disengaging and thereby decoupling said flywheel from said cam shaft, said wrap spring clutch initiating rotation of said cam shaft.

25. The wrap spring clutch syringe ram of claim 24, further comprising:

an electric power source supplying electrical power to said solenoid.

26. The wrap spring clutch syringe ram of claim 25, further comprising:

a switch being disposed between said electric power source and said solenoid, said switch controlling the actuation of said solenoid.

27. The wrap spring clutch syringe ram of claim 26, further comprising:

a computer controlling the actuation of said switch.

28. The wrap spring clutch syringe ram of claim 27, further comprising:

a potentiometer having a moveable tang which changes the resistance thereof, said potentiometer being mounted adjacent to said slide platform, said slide platform moving said moveable tang as said slide platform is moving forward, said potentiometer being connected to said computer through an A/D converter, the electrical output of said potentiometer indicating the position of said slide platform.

29. The wrap spring clutch syringe ram of claim 24, further comprising:

a mixer receiving an output of said at least one syringe.

30. The wrap spring clutch syringe ram of claim 29, further comprising:

said mixer being a frit mixer, a porous frit being inserted into said frit mixer.

31. The wrap spring clutch syringe ram of claim 30, further comprising:

an entrance to said porous frit of said frit mixer being flared to provide improved flow from said at least one syringe; and an exit from said porous frit of said frit mixer being flared to provide improved flow from said frit mixer.

32. The wrap spring clutch syringe ram of claim 29, further comprising:

a reactor to receive an output of said mixer.

33. The wrap spring clutch syringe ram of claim 24, further comprising:

a speed control to enable adjustment of the rotational velocity of said motor.

34. The wrap spring clutch syringe ram of claim 33, further comprising:

a feedback control to enable maintenance of the rotational velocity of said motor.

35. The wrap spring clutch syringe ram of claim 24 further comprising:

a reactor to receive an output of said at least one syringe.

36. The wrap spring clutch syringe ram of claim 24, further comprising:

a tachometer being used to monitor the velocity of rotation of said flywheel, said motor, or said cam shaft.

37. The wrap spring clutch syringe ram of claim 24, further comprising:

a support for restraining a barrel of each of said at least one syringe from movement.

38. The wrap spring clutch syringe ram of claim 24, further comprising:

a means for decoupling said wrap spring clutch from said cam shaft to rotate said cam shaft.

39. The wrap spring clutch syringe ram of claim 24, further comprising:

a means to coordinate engagement, disengagement and braking of said wrap spring clutch.

* * * * *